US007790343B2

(12) United States Patent
Suzuki et al.

(10) Patent No.: US 7,790,343 B2
(45) Date of Patent: Sep. 7, 2010

(54) PROCESS, TONER, PROCESS CARTRIDGE AND APPARATUS FOR DEVELOPING A TONER IMAGE

(75) Inventors: Kazumi Suzuki, Shizuoka (JP); Hiromitsu Takagaki, Kanagawa (JP); Takashi Fujita, Kanagawa (JP); Atsushi Nakafuji, Tokyo (JP); Hiromi Tamura, Kanagawa (JP); Shin Kayahara, Kanagawa (JP); Tsuyoshi Sugimoto, Kanagawa (JP); Takashi Seto, Kanagawa (JP); Katsuaki Miyawaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 558 days.

(21) Appl. No.: 11/669,817

(22) Filed: Jan. 31, 2007

(65) Prior Publication Data

US 2007/0218386 A1 Sep. 20, 2007

(30) Foreign Application Priority Data

Mar. 17, 2006 (JP) ..... 2006-075431

(51) Int. Cl.
*G03G 9/08* (2006.01)

(52) U.S. Cl. ..... 430/109.4; 430/111.4; 430/123.53; 430/123.54; 399/159

(58) Field of Classification Search ..... 430/108.4, 430/109.4, 111.4, 110.1, 123.53, 123.54; 399/159

See application file for complete search history.

(56) References Cited

U.S. PATENT DOCUMENTS

| | | | |
|---|---|---|---|
| 5,456,782 | A | 10/1995 | Fujita et al. |
| 5,783,288 | A | 7/1998 | Fujita et al. |
| 6,108,906 | A | 8/2000 | Fujita et al. |
| 6,122,479 | A | 9/2000 | Fujita et al. |
| 6,631,253 | B2 | 10/2003 | Nakafuji et al. |

(Continued)

FOREIGN PATENT DOCUMENTS

| | | |
|---|---|---|
| JP | 09-034163 | 2/1997 |

(Continued)

OTHER PUBLICATIONS

U.S. Appl. No. 07/966,508, filed Oct. 23, 1992, Fujita, et al.

(Continued)

*Primary Examiner*—John L Goodrow
(74) *Attorney, Agent, or Firm*—Oblon, Spivak, McClelland, Maier & Neustadt, L.L.P.

(57) ABSTRACT

A process includes developing toner images on a photoconductor, transferring to an intermediate transfer belt and a transferring-and-fixing roller. The toner images are transferred to and fixed to a paper simultaneously while the paper moves between the transferring-and-fixing roller and a pressure roller which is pressed against the transferring-and-fixing roller. After transfer process to the paper, residual toner particles remaining on the transferring-and-fixing roller are removed by a cleaning roller. In order to achieve a cleanability from the transferring-and-fixing roller and prevent the intermediate belt from becoming too high temperature, the elastic modulus of the toner particles measured when the toner particles are heated is greater than the elastic modulus of the toner particles when cooled in a temperature range where the glass transition temperature and 10° C. lower than the melting temperature of the toner particles.

23 Claims, 7 Drawing Sheets

U.S. PATENT DOCUMENTS

| | | | | |
|---|---|---|---|---|
| 6,778,794 | B2 | 8/2004 | Kayahara | |
| 6,795,676 | B2 | 9/2004 | Kikuchi et al. | |
| 6,795,678 | B2 | 9/2004 | Yura et al. | |
| 6,957,036 | B2 | 10/2005 | Kikuchi et al. | |
| 7,010,257 | B2 | 3/2006 | Someya et al. | |
| 7,031,648 | B2 | 4/2006 | Takashi et al. | |
| 7,079,798 | B2 | 7/2006 | Suzuki et al. | |
| 7,127,202 | B2 | 10/2006 | Fujita et al. | |
| 7,177,580 | B2 | 2/2007 | Nakafuji et al. | |
| 2002/0018952 | A1* | 2/2002 | Daimon et al. | 430/109.4 |
| 2003/0054280 | A1* | 3/2003 | Ishihara et al. | 430/124 |
| 2004/0058260 | A1 | 3/2004 | Katoh et al. | |
| 2005/0147911 | A1* | 7/2005 | Shirai et al. | 430/109.4 |
| 2005/0152721 | A1 | 7/2005 | Kikuchi et al. | |
| 2005/0158075 | A1 | 7/2005 | Echigo et al. | |
| 2005/0201783 | A1 | 9/2005 | Kurotaka et al. | |
| 2005/0207801 | A1 | 9/2005 | Kunii et al. | |
| 2005/0254846 | A1 | 11/2005 | Yura et al. | |
| 2005/0286920 | A1 | 12/2005 | Baba et al. | |
| 2006/0008302 | A1 | 1/2006 | Someya et al. | |
| 2006/0013624 | A1 | 1/2006 | Kurotaka et al. | |
| 2006/0019082 | A1 | 1/2006 | Kikuchi et al. | |
| 2006/0120776 | A1 | 6/2006 | Takashi et al. | |
| 2006/0140689 | A1 | 6/2006 | Echigo et al. | |
| 2006/0177756 | A1 | 8/2006 | Sugimoto et al. | |

FOREIGN PATENT DOCUMENTS

| | | |
|---|---|---|
| JP | 09-305033 | 11/1997 |
| JP | 10-063121 | 3/1998 |
| JP | 2001-092274 | 4/2001 |
| JP | 2001-188421 | 7/2001 |
| JP | 2002-105414 | 4/2002 |
| JP | 2002-244450 | 8/2002 |
| JP | 2003-316176 | 11/2003 |
| JP | 2004-145260 | 5/2004 |
| JP | 2006-030249 | 2/2006 |

OTHER PUBLICATIONS

U.S. Appl. No. 08/423,046, filed Apr. 17, 1995, Fujita, et al.
U.S. Appl. No. 12/042,143, filed Mar. 4, 2008, Kayahara, et al.
U.S. Appl. No. 12/164,921, filed Jun. 30, 2008, Suzuki et al.
U.S. Appl. No. 12/144,078, fled Jun. 23, 2008, Kayahara et al.
U.S. Appl. No. 12/144,267, filed Jun. 23, 2008, Yasutomi, et al.

* cited by examiner

PROCESS, TONER, PROCESS CARTRIDGE AND APPARATUS FOR DEVELOPING A TONER IMAGE

CROSS REFERENCE OF RELATED APPLICATION

This application is claims the benefit of priority to Japanese Patent Application No. 2006-075431, incorporated herein by reference in its entirety.

BACKGROUND OF THE INVENTION

1. Field of the Invention

The invention relates to an image forming process, a toner, and an apparatus for carrying out the process such as a copier, a printer, a fax and a multifunctional machine using toner particles.

2. Description of the Related Art

Japanese Laid-Open Patent Publication No. 2004-145260 discloses an image forming apparatus including at least a latent image carrier, a developing device that develops latent images on the latent image carrier to toner images, an intermediate transfer body to which developed toner images are transferred from the latent image carrier, an transferring-and-fixing body to which toner images are transferred from the intermediate transfer body, a heater to heat toner images on the transferring-and-fixing body, a pressure body pressing to the transferring-and-fixing body in order to transfer and fix toner images on the transferring-and-fixing body to a paper moving between the transferring-and-fixing body and the pressure body, and a cleaner to clean residual toner images from the transferring-and-fixing body after fixing process.

In this type of image forming apparatus, since toner particles are transferred and fixed to a paper after it is heated, it is not necessary to heat the paper with temperature as high as that of a conventional image forming apparatus in which toner particles are heated on a paper. Thus, toner particles can be fixed to a paper with less heat and energy saving can be achieved.

However, there is a feature in this type of image forming apparatus that heat on the heated transferring-and-fixing body may transfer to toner particles in the developing device by way of the intermediate transfer body and the latent image carrier. If the heat is high enough soften toner particles in the developing device, softened toner particles will adhere to the surface of the latent image carrier to form a film of toner material thereon. This situation is called "toner filming". Once toner filming occurs, the quality of toner images on the latent image carrier deteriorates and so do toner images on a paper.

One possible solution to suppress this "toner filming" is to reduce the temperature of the transferring-and-fixing body after fixing so that the amount of heat transferred from the transferring-and-fixing body to the intermediate body is reduced. If the amount of heat transferring from the transferring-and-fixing body to the intermediate body is reduced, the rise of the temperature of toner particles in the developing device is reduced and toner filming is reduced.

However, if the temperature of residual toner particles on the transferring-and-fixing body is too low, it becomes difficult to remove residual toner particles by the cleaner because the viscosity of any residual toner particles becomes higher under low temperature.

If unremoved residual toner particles remain on the transferring-and-fixing body, those toner particles may adhere to a paper at next image forming process and the image on a paper may be contaminated.

This contamination can be improved by keeping the temperature of the transferring-and-fixing body and residual toner particles high after the fixing process. However, if the temperature is kept high, the "toner filming" may occur as mentioned above.

On the other hand, Japanese Laid-Open Patent Publication No. H10-63121 discloses an image forming apparatus including at least a latent image carrier, a developing device that develops latent images on the latent image carrier to toner images, an intermediate transfer body to which developed toner images are transferred from the latent image carrier, a heater to heat toner images on the intermediate transfer body, a pressure body pressing to the intermediate transfer body in order to make toner images on the intermediate transfer body be transferred and fixed to a paper moving between intermediate transfer body and the pressure body, and a cleaner to clean residual toner images from the intermediate transfer body after fixing process.

This type of image forming apparatus is almost the same as the previous one, except there is no transferring-and-fixing body. Toner images on the intermediate transfer body are heated and softened by the heater. Softened toner images are transferred to a paper and simultaneously fixed to the paper.

This type of image apparatus has the same merits and demerits as previously explained for the image forming apparatus. Lowering the temperature of the intermediate transfer body and residual toner images after the transfer process results in the decline of cleanability of the intermediate transfer body. Keeping temperature of the intermediate transfer body and residual toner images high results in the toner filming on the latent image carrier and decline of the image quality.

SUMMARY OF THE INVENTION

Accordingly, one object of the invention is to provide toner particles that have a different storage elastic modulus when heated and cooled.

Another object of the invention is to provide toner particles with which toner filming on a latent image carrier is prevented sufficiently and residual toner images can be removed sufficiently.

Another embodiment of the invention is a process for developing a toner image using the toner of the invention.

Another object of the invention is to provide an image forming apparatus which prevents toner filming on a latent image carrier and concurrently permits the removal of excess toner.

Another object of the invention is to provide process cartridge that contains the toner of the invention.

DETAILED DESCRIPTION OF THE PREFERRED EMBODIMENTS

An exemplary embodiment of the present invention is explained in detail below with reference to the accompanying drawings. The exemplary embodiment is a preferred embodiment and the present invention is not restricted to the details of this embodiment.

In this application, "° C." as a unit of temperature means "degree Celsius".

Figure 1:
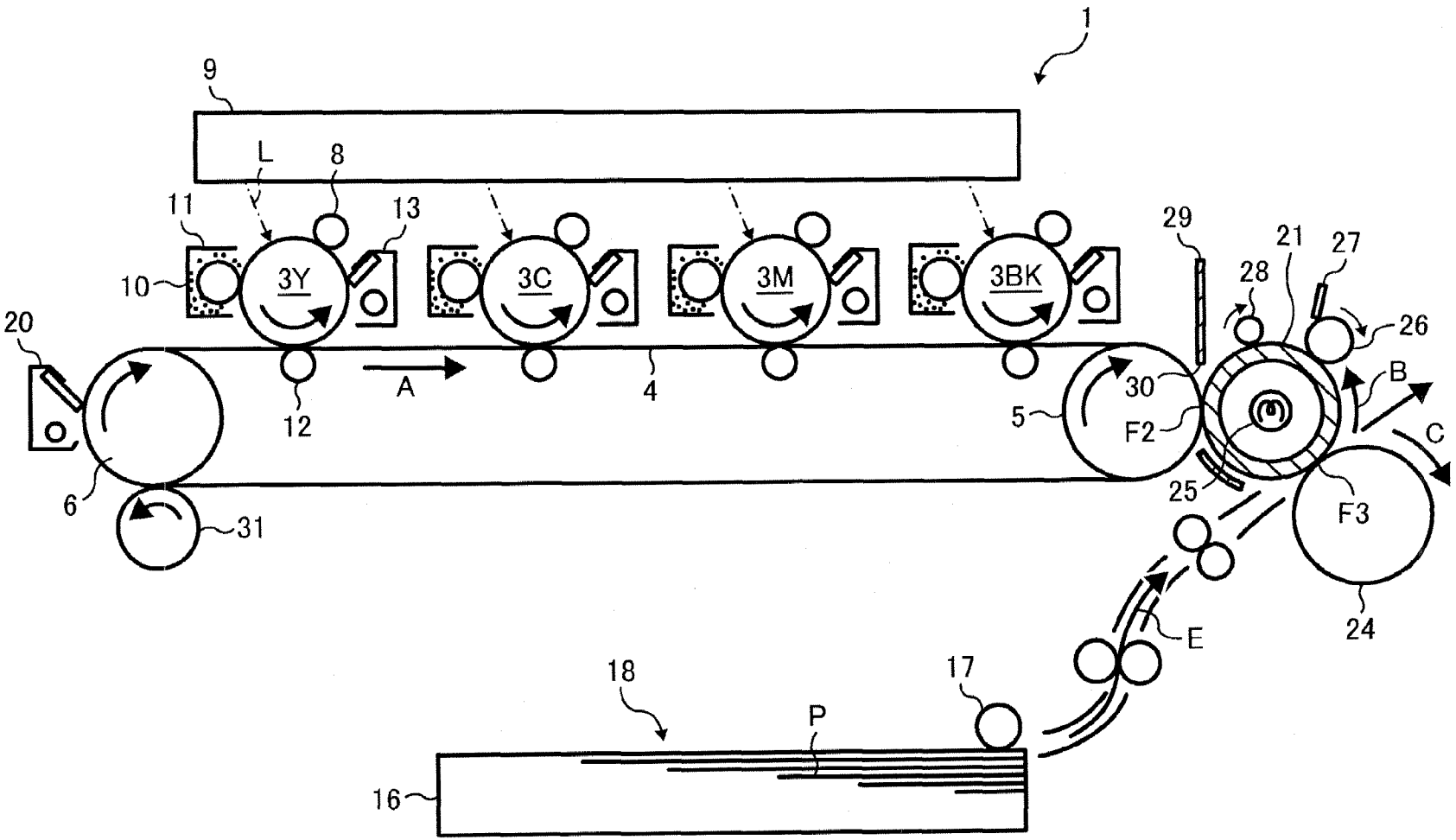
FIG. 1 shows a cross section of an embodiment of an image forming apparatus.

As shown in FIG. 1, an image forming apparatus 1 includes image carriers 3Y, 3C, 3M and 3BK, an seamless intermediate transfer belt 4 (as an intermediate transfer body), rollers 5 and 6, a charge roller 8, an optical writing unit 9, a developing device 10, a first transfer roller 12, a cleaner 13, a sheet feed cassette 18. The image forming apparatus may have more or less image carriers than the 3Y, 3C, 3M and 3BK carriers shown in FIG. 1.

Each of the latent image carriers 3Y, 3C, 3M, and 3BK is a drum-shaped photoconductor on which yellow, cyan, magenta and black toner images are formed, respectively. The intermediate transfer belt 4 extends around the rollers 5 and 6, and is driven in the direction of arrow A as shown in FIG. 1 by driving the rollers 5 in clockwise direction with a driving motor (not shown). The roller 6 rotates in clockwise direction according to movement of the intermediate transfer belt 4.

A belt photoconductor can be used instead of a drum-shaped photoconductor. A drum-shaped intermediate transfer device can be used instead of an intermediate transfer belt.

Each of the latent image carriers 3Y, 3C, 3M, and 3BK has a substantially similar configuration for forming a toner image thereon. Therefore, the latent image carrier 3Y is used for explaining a toner image formation on the latent image carriers 3 Y, 3C, 3M, and 3BK, hereinafter.

The latent image carrier 3Y rotates in a counterclockwise direction as shown in FIG. 1 and a surface of the latent image carrier 3 Y is uniformly charged to a predetermined voltage by the charge roller 8 (as an example of a charger) during rotation. The charged surface of the latent image carrier 3Y is scanned by a laser beam "L", modulated and emitted from the optical writing unit 9, to write an electrostatic latent image on the latent image carrier 3Y. The electrostatic latent image is developed, or made visible, forming a yellow toner image on the latent image carrier 3Y by the developing device 10.

The developing device 10 in this embodiment contains a two-component developer including toner particles and carrier particles in a case 11 and develops latent images using toner particles in the two-component developer. However, a one-component developer not including carrier particles can be used as well.

As shown in FIG. 1, the first transfer roller 12 and the latent image carrier 3Y sandwiches the intermediate transfer belt 4 therebetween. The first transfer roller 12, charged with a polarity opposite to the polarity of the toner particles on the latent image carrier 3Y, transfers the yellow toner image to the intermediate transfer belt 4 from the latent image carrier 3Y. Toner particles remaining on the latent image carrier 3Y after transfer process are removed by the cleaner 13. And the surface of the latent image carrier 3Y is initialized by a light from a discharger (not shown).

Similarly, cyan, magenta, and black toner images are formed on the latent image carriers 3C, 3M, and 3BK, respectively. These toner images are sequentially superimposed on the intermediate transfer belt 4 and a full color image is formed on the intermediate transfer belt 4.

Instead of using an image forming apparatus including plural latent image carriers 3Y, 3C, 3M, and 3BK, it is possible to use an image forming apparatus including only one image carrier, plural developing devices and an intermediate transfer body. In the this kind of image forming apparatus including only one image carrier, each color toner image is formed on the latent image carrier one after the other and transferred to the intermediate transfer body one after the other and multi color image is formed on the intermediate transfer body.

A transferring-and-fixing roller 21 (as a transferring-and-fixing body) is disposed next to the roller 5, pinching the intermediate transfer belt 4 between the transferring-and-fixing body 21 and the roller 5, rotating in the direction B with the same surface speed as the surface speed of the intermediate transfer belt 4. A pressure roller 24 (as a pressure body) is pressed against the transferring-and-fixing roller 21, rotating in the direction C.

The transferring-and-fixing roller 21 is implemented by a hollow cylindrical pipe formed of aluminum or similar metal and coated with a releasing layer. A heater 25 is disposed in the transferring-and-fixing roller 21. As the heater 25, for example, a halogen heater can be used. As another embodiment, a heater can be disposed in the vicinity of the surface of the transferring-and-fixing roller 21 or included the surface of the transferring-and-fixing roller 21.

An electric bias is imposed on the roller 5 by an electric source (not shown). The transfer bias can include an alternating bias or a pulse bias. The full-color toner image on the intermediate transfer belt 4 is transferred to the transferring-and-fixing roller 21, at the position F2 in FIG. 1, by an electrostatic force derived from a bias applied to the drive roller 5. The full-color toner image on the transferring-and-fixing roller 21 is heated by the heater 25 and softened. On the other hand, residual toner particles on the intermediate transfer belt 4 are removed by a cleaner 20.

Under the intermediate transfer belt 4, the sheet feed cassette 18 is disposed, including papers P (as recording mediums) in a paper supply tray 16 and a feeding roller 17 contacting with a paper on the top. Papers are sent in the direction E by rotation of the feeding roller 17 and fed to a position between the transferring-and-fixing roller 21 and the pressure roller 24 at a predetermined timing.

Here, a "paper" is an example of a recording medium. This invention can be applied to various other recording mediums such as OHP (overhead projector) sheets.

While a paper P moves through between the transferring-and-fixing roller 21 and the pressure roller 24, a position F3 in FIG. 1, softened toner images on the transferring-and-fixing roller 21 are transferred to the paper, being fixed to the paper simultaneously under the influence of heat and pressure. Then, the paper is ejected to a sheet eject tray (not shown).

As described above, the image forming apparatus in this embodiment includes the transferring-and-fixing roller 21 to which toner images are transferred from the intermediate transfer belt, the heater 25 to heat toner images on the transferring-and-fixing roller 21, the pressure roller 24 pressed to the transferring-and-fixing roller 21.

Toner particles remaining on the transferring-and-fixing roller 21 after fixing are removed by the cleaning roller 26 (an example of cleaner for the transferring-and-fixing body) and the transferring-and-fixing roller 21 are cleaned up.

The cleaning roller 26 contacts with the surface of the transferring-and-fixing roller 21 and rotates in direction as shown in FIG. 1, following the rotation of the transferring-and-fixing 21 or driven by a driving device (not shown). The surface of the cleaning roller 26 is covered with material which has lower releasability than the surface of the transferring-and-fixing roller 21. Here, "releasability" is a feature of material that shows how easy toner particles can be released from the material. The higher the "releasability" is, the easier toner particles are released. The deference of the releasability between the transferring-and-fixing 21 and the cleaning roller 26 makes residual toner particles transfer from the transferring-and-fixing 21 to the cleaning roller 26. Toner particles having transferred to the cleaning roller 26 are scraped by a scraper 27. When a paper P is jammed in the image forming apparatus and therefore toner images can not be transferred to the paper, the toner images can be removed by the cleaning roller 26.

The surface of the transferring-and-fixing roller 21 includes a material having high releasability. For example, a material mainly compounded from perfluoro-resins whose hydrogen groups are almost all replaced by fluorine groups, such as PTFE (polytetrafluoroethylene), PFA (perfluoro-alkoxy), FEP (fluorinated ethylene propylene) and the like can be used as the surface. Fillers such as carbon can be contained in the surface of the transferring-and-fixing roller 21 by less than some percentage.

The releasability of a material can be expressed as a contact angle formed by water and the surface of the material. The contact angle relates to surface energy. The smaller the surface energy is, the greater the contact angle is. It is well known that above-mentioned materials have a very small surface energy and have the contact angle of about 100 to 120°.

On the other hand, in order to make softened toner particles on the transferring-and-fixing roller 21 transfer to the cleaning roller 26, it is preferable that the surface of the cleaning roller 26 is compounded from a material having a contact angle of from 70 to 105°. The material having such a contact angle can be easily obtained by using PTFE, PFA or FEP filled with from 10% to 20% of hardly-worn-out fillers made from carbon, glass fiber, ceramic or molybdenum disulfite having excellent lubricating property, or physically strong perfluoro-resins such as ETFT (ethylenetetrafluoroethylene copolymer) half of whose hydrogen groups are replaced by fluorine groups. It is preferable to use a material including fillers because the material can be hardly worned out during scraping of toner particles, not mention to having a proper contact angle.

If the contact angle of the cleaning roller 26 is smaller than 70°, toner particles easily adhere to the surface of the cleaning roller 26 and are hardly scraped out.

Figure 2:
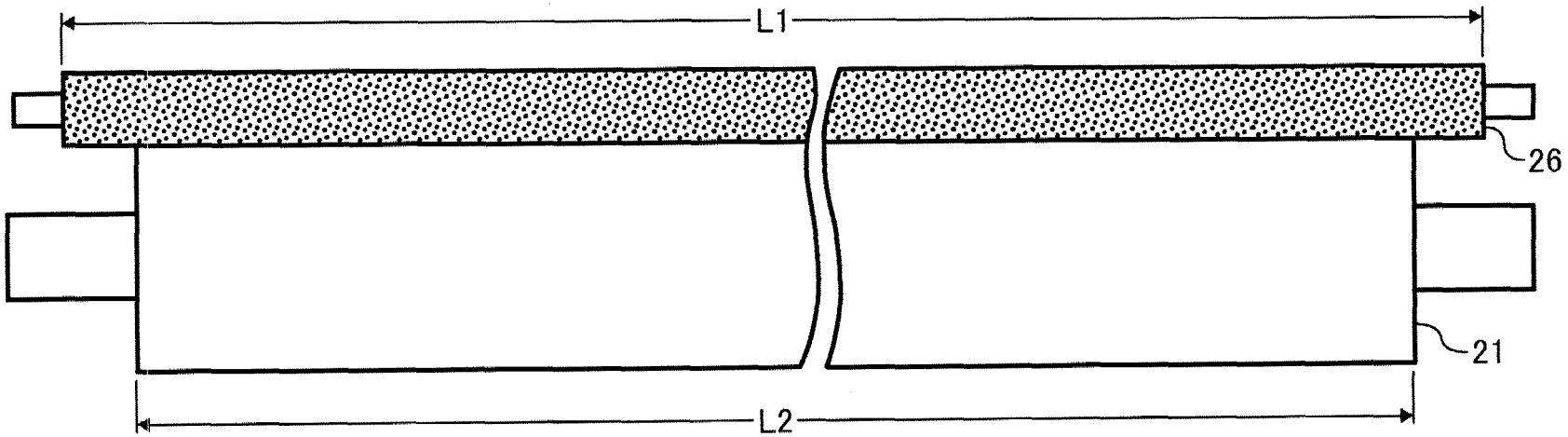
FIG. 2 shows one example of the transferring-and-fixing roller contacts a cleaning roller.

It is preferable that fine convexes and concaves are formed on the surface of the cleaning roller 26 in order to improve the efficiency to remove residual toner particles from the transferring-and-fixing roller 21. Moreover, it is preferable to arrange L1 to be greater than L2 as shown in FIG. 2. Here, L1 is a length of the cleaning roller 26 having fine convexes and concaves in the axis direction. L2 is a length of the transferring-and-fixing roller 21 in the axis direction. By arranging L1 to be greater than L2, residual toner particles on every peripheral surface of the transferring-and-fixing roller 21 can be removed by the cleaning roller 26.

The photoconductor 3Y can be designed to be detachable from main body of the image forming apparatus, together with at least one of the charging roller 8, the developing device 10 and the cleaner 13. The detachable unit is called a "process cartridge". Similarly, each of the photoconductor 3C, 3M or 3BK can be formed as a process cartridge, together with at least one of the charging roller 8, the developing device 10 and the cleaner 13 around it. In one embodiment the process cartridge includes the toner.

Here, "main body of the image forming apparatus" is the image forming apparatus not containing the process cartridge.

In the image forming apparatus explained above, since toner images are transferred and simultaneously fixed to a paper P after being softened, a paper P itself does not need to be heated. Therefore, fixing process can be achieved with low temperature or warm-up time can be shortened. And energy used for fixing process can be saved. In the image forming apparatus used in this embodiment, toner particles can be transferred and fixed to a paper P even if the surface temperature of the transferring-and-fixing roller 21 is from 110 to 120° C.

However, since the transferring-and-fixing roller 21 is heated by the heater 25, the heat on the heated transferring-and-fixing roller 21 can transfer to toner particles in the developing device 10 by way of the intermediate transfer belt 4 and the latent image carriers 3Y, 3C, 3M and 3BK. If the heat is enough high to soften toner particles in the developing device 10, softened toner particles will adhere to the surface of the latent image carrier to form "toner filming".

It is possible to reduce the heat transferred to the intermediate belt 4 and therefore improve "toner filming" by reducing the rotating speed of the transferring-and-fixing roller 21. If the rotating speed of the transferring-and-fixing roller 21 is reduced, it takes longer time for the surface of the transferring-and-fixing roller 21 to arrive the position F2 after passing the position F3 and therefore the temperature of the transferring-and-fixing roller 21 at the position F2 becomes lower.

The same effect can be obtained by providing a cooler at a downstream position of F3 and an upstream position of F2 in the rotating direction of the transferring-and-fixing roller 21, in order to cool the surface of the transferring-and-fixing roller 21 and to reduce the heat transferred to the intermediate transfer belt 4.

However, lowering the temperature of the transferring-and-fixing roller 21 by above mentioned method results in lowering the temperature of residual toner particles on the transferring-and-fixing roller 21. Therefore, the efficiency to remove residual toner particles may decline and remaining toner particles on the transferring-and-fixing roller may adhere to the non-image area on a nest paper. The details of this phenomena will be explained below.

Figure 6:
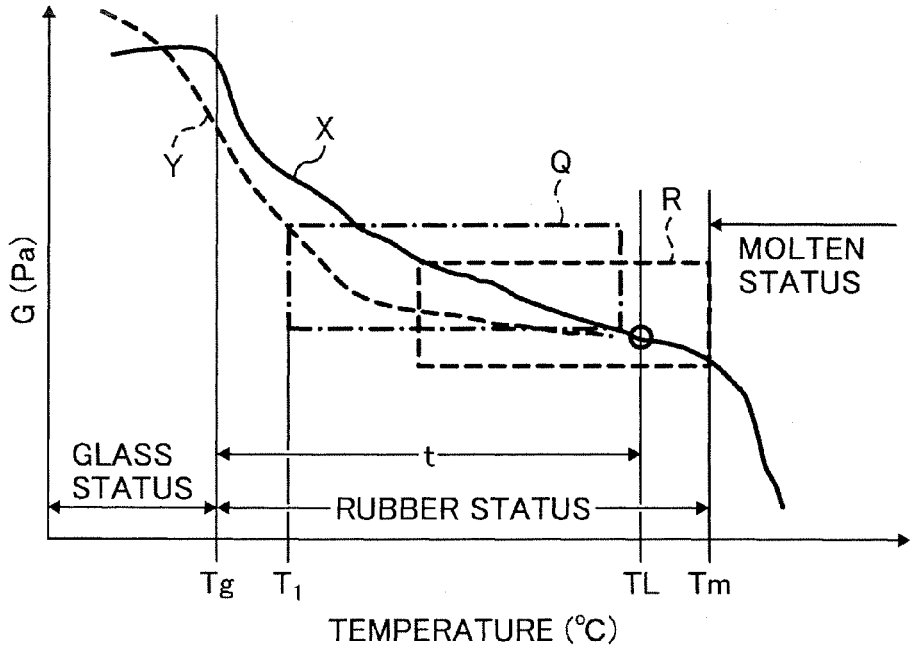
FIG. 6 shows an example of the relation between the temperature of toner particles and the storage elastic modulus of toner particles.
Figure 7:
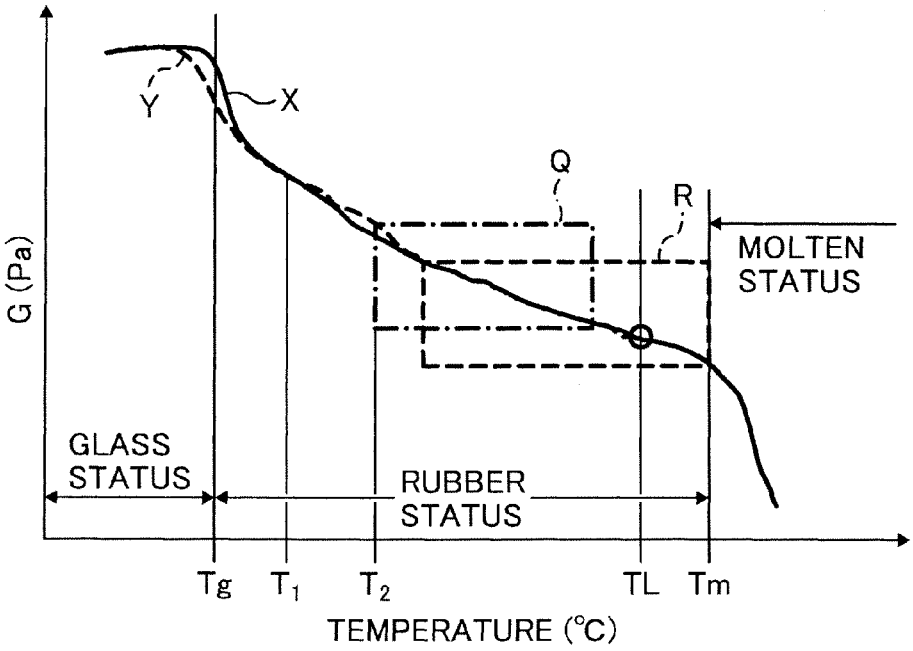
FIG. 7 shows the relation between the temperature of conventional toner particles and the storage elastic modulus of conventional toner particles.

FIG. 6 is a graph indicating the feature of toner particles used in this embodiment. FIG. 7 is a graph indicating the feature of conventional toner particles. A horizontal axis in each graph indicates the temperature of toner particles and vertical axis indicates a storage elastic modulus of toner particles G [Pa]. Tg indicates a glass transition temperature of toner particles measured when toner particles are heated. Tm indicates a flow starting temperature of toner particles.

In FIGS. 6 and 7, a solid line X indicates the storage elastic modulus of toner particles G [Pa] measured when toner particles are heated. On the other hand, a dotted line Y indicates the storage elastic modulus of toner particles G [Pa] measured when toner particles are cooled from a temperature TL which is 10° C. lower than Tm.

It is difficult to measure the value G [Pa] precisely after toner particles are once heated to a temperature not lower than Tm and then cooled. Therefore, the value G [Pa] when toner particles are cooled (dotted line Y) is shown only at the temperature not greater than TL.

It is preferable that the storage elastic modulus of toner particles G [Pa] is within an area surrounded a dotted square R in FIGS. 6 and 7 in order to fix toner images to the paper P well.

Besides, the efficiency to remove residual toner particles remaining on the transferring-and-fixing roller 21 by the cleaning roller 26 also relates to the value G [Pa]. The range in which the efficiency to remove residual toner particles remaining on the transferring-and-fixing roller 21 is high is an area surrounded a dotted square Q in FIGS. 6 and 7.

As shown in FIG. 7, with regard to conventional toner particles, the value of G [Pa] measured when toner particles are heated is almost the same as the value of G [Pa] measured when toner particles are cooled. Therefore, if toner particles on the transferring-and-fixing roller 21 are heated to the area R in which toner particles can be fixed efficiently and, after transfer process to a paper P, cooled down to the temperature T1 in FIG. 7, the residual toner particles on the transferring-and-fixing roller 21 can not be removed efficiently by the cleaning roller 26 because the temperature T1 is lower than the area Q in which toner particles can be removed efficiently. Therefore, toner particles may remain on the transferring-and-fixing roller 21 and cause toner adhesion to a non-image area of an image on a next paper.

If the temperature of the residual toner particles on the transferring-and-fixing roller 21 is designed to be a temperature T2 within the area Q, the temperature of toner particles in the developing device may be enough high to cause the "toner filming" because the temperature T2 is higher than the temperature T1 and the high heat are transferred to the developing device by way of the intermediate transfer belt 4 and the photoconductor 3Y, 3C, 3M and 3BK.

On the other hand, with regard to toner particles shown in FIG. 6, the value of G [Pa] measured when toner particles are heated (the solid line X) is higher than the value of G [Pa] measured when toner particles are cooled (the dotted line Y). More accurately, toner particles in this embodiment satisfy a following relation within a range of temperature not smaller than Tg and smaller than TL.

$$Gr>Gl$$

Here, Gr is the value of G [Pa] measured when toner particles are heated and Gl is the value of G [Pa] measured when toner particles are cooled.

Therefore, the area Q of toner particles in FIG. 6 is broad compared with the area Q of conventional toner particles shown in FIG. 7. If the temperature of residual toner particles becomes lower than T1, the residual toner particles can be still efficiently removed from the transferring-and-fixing roller 21 by the cleaning roller 26. In other word, if toner particles on the transferring-and-fixing roller 21 are heated to the area R in which toner particles can be fixed efficiently and, after transfer process to a paper P, cooled down to the temperature T1 in FIG. 6, the residual toner particles on the transferring-and-fixing roller 21 can be still removed efficiently by the cleaning roller 26. Besides, lowering the temperature of residual toner particles results in lowering the temperature of transferring-and-fixing roller 21 at the position F2. Therefore the heat transferred to the photoconductor 3Y, 3C 3M and 3BK by way of the intermediate transfer belt 4 is reduced and "toner filming" is reduced effectively.

By using toner particles having the feature shown in FIG. 6, "toner filming" can be reduced and high quality full color image can be formed on a paper P without declining the efficiency to remove the residual toner particles by the cleaning roller 26. Besides, since the excessive rise of the temperature of the intermediate transfer belt 4 is prevented, the lifetime of the intermediate transfer belt 4 is prolonged.

It is preferable to design a temperature "tf" and "tc" and the storage elastic modulus of toner particles "Gr(tf)" and "Gl (tc)" to satisfy following relation.

$$tf-30(^\circ\text{ C.})>tc(^\circ\text{ C.})$$

$$Gl(tc)/Gr(tf)<10$$

Here, "tf" is the temperature of toner particles when the toner particles on the transferring-and-fixing roller 21 are transferred to a paper P. "tc" is the temperature of residual toner particles when the residual toner particles on the transferring-and-fixing roller 21 are removed by the cleaning roller 26. Gr(tf) is the value of G [Pa] measured at the temperature "tf" while toner particles are being heated. Gl(tc) is the value of G [Pa] measured at the temperature "tc" while toner particles are being cooled.

By designing the temperature "tc" to be lower than "tf−30"° C., the heat transferred to the photoconductors by way of the intermediate transfer belt 4 can be reduced dramatically. Besides, by designing Gl(tc) and Gr(tf) to satisfy Gl(tc)/Gr (tf)<10, the storage elastic modulus of toner particles can be reduced when the residual toner particles are removed from the transferring-and-fixing roller 21 and therefore toner particles can be removed efficiently from the transferring-and-fixing roller 21.

It is preferable to design toner particles so that Gr(tf) and Gl(tc) satisfy following relations.

$$5\times10^2\text{ [Pa]}<Gr(tf)<1\times10^4\text{ [Pa]}$$

$$1\times10^3\text{ [Pa]}<Gl(tc)<5\times10^4\text{ [Pa]}$$

Here, $10^n$ is the n-th power of 10.

By satisfying these relations, toner particles having transferred from the transferring-and-fixing roller 21 to a paper P can be fixed efficiently and the gross of toner images fixed to the paper P can be heightened. Besides, residual toner particles remaining on the transferring-and-fixing roller 21 can be removed efficiently by the cleaning roller 26.

Since the cleaning roller 26 contacts with the surface of the transferring-and-fixing roller 21 after transfer process to a paper P, the heat of the transferring-and-fixing roller 21 can be transferred to the cleaning roller 26. But it is more preferable to dispose a cooler at upstream of the position F2 and at downstream of the position F3 in the rotating direction of the transferring-and-fixing roller 21. The cooler can reduce the heat of the transferring-and-fixing roller 21 at the position F2 and therefore reduce the heat to be transferred to the intermediate transfer belt 4. In this embodiment, as shown in FIG. 1, a heat pipe 28 is disposed between the position F2 and F3 as a cooler. The heat pipe 28 actively cools the surface of the transferring-and-fixing roller 21.

As shown in FIG. 1, a heat insulation plate 29 is interposed between the intermediate transfer belt 4 and the image transferring-and-fixing roller 21 and plays the role of a heat screening body for controlling the heat radiation or heat transfer from the image transferring-and-fixing roller 21 to the intermediate transfer belt 4. The heat insulation plate 29 formed with an opening 30 so as not to obstruct the intermediate transfer belt 4 from the image transferring-and-fixing roller 21. The heat insulation plate 29 reduces the heat transferred to the intermediate transfer belt 4 and therefore improve the "toner filming".

The heat insulation plate 29 is preferably implemented as a glossy plate with a low radiation ratio, more preferably two metallic sheets positioned at opposite sides of a small gap or an insulator. Further, a thin plate having a microheat pipe structure used to cool a CPU (Central Processing Unit) mounted on a notebook size personal computer is used, the heat insulation plate 29 can be held at low temperature for controlling heat transfer.

Further, in this embodiment, a cooling roller 31 is disposed at the downstream of the position F2 and the upstream of the positions at which toner particles on the photoconductors are transferred to the intermediate transfer belt 4, in the moving direction of the surface of the intermediate transfer belt 4. The cooling roller 31 effectively reduces the heat transfer to the photoconductors. The cooling roller 31 is made from a material having high heat conductivity and rotates while contacting with the intermediate transfer belt 4

As explained above, in one embodiment the image forming apparatus preferably includes the cooling roller 31, the heat pipe 28 and the heat insulation plate 29. Each one of these three elements can independently reduce the heat transfer to the intermediate transfer belt 4 or all of these elements can reduce the heat transfer to the intermediate transfer belt 4. Or, it is possible to cool the image transferring-and-fixing roller 21 by the cleaning roller 26 without any of the cooling roller 31, the heat pipe 28 and the heat insulation plate 29.

Figure 3:
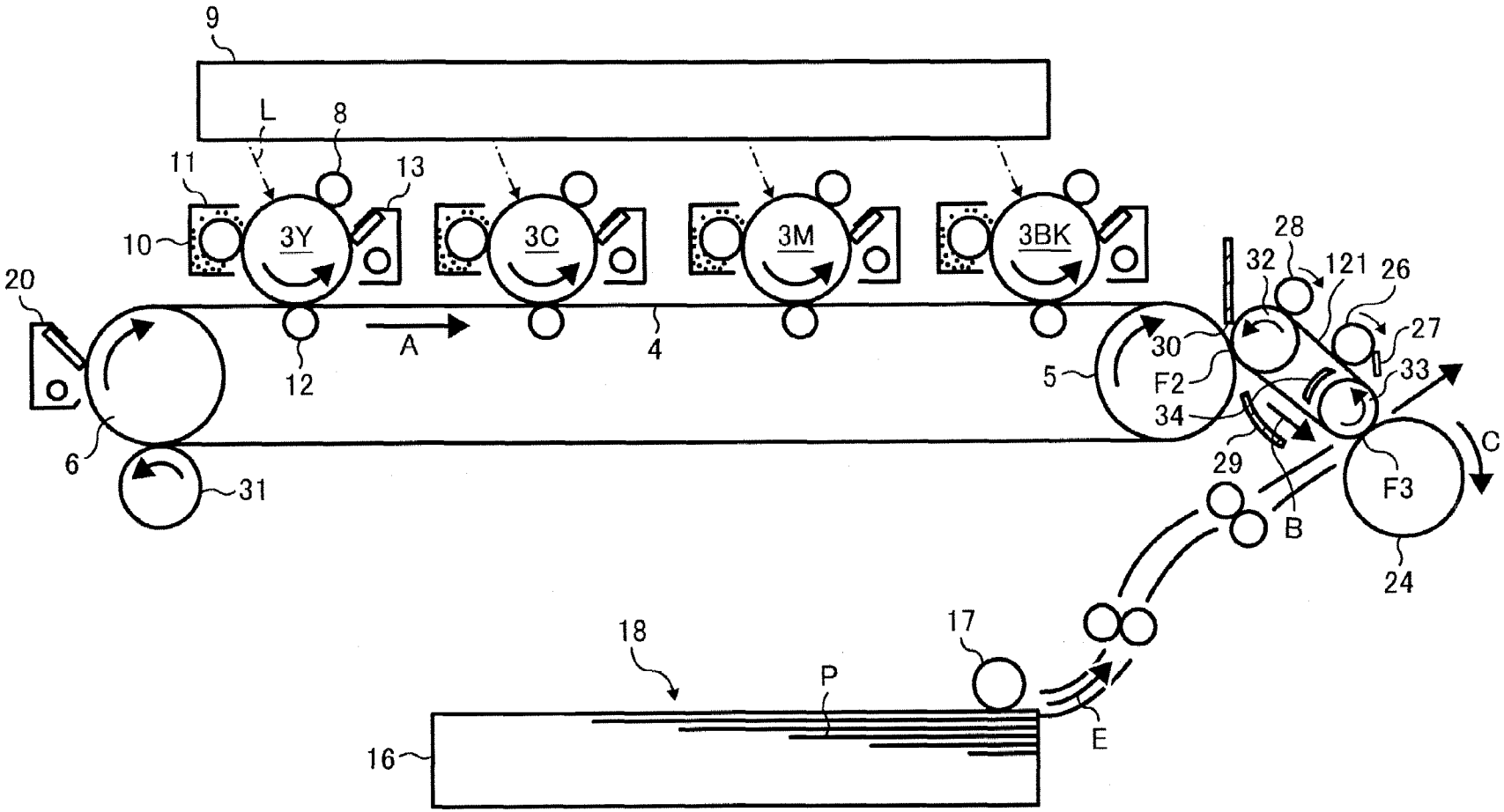
FIG. 3 shows a cross section of another embodiment of an image forming apparatus.

In an image forming apparatus shown in FIG. 3, an image transferring-and-fixing body rotating while contacting with the intermediate transfer belt 4 is implemented as an image transferring-and-fixing belt 121 being spanned by two supporting roller 32 and 33. The image transferring-and-fixing belt 121 rotates in the direction B in FIG. 3 and toner images on the intermediate transfer belt 4 are transferred to the image transferring-and-fixing belt 121.

In the image forming apparatus shown in FIG. 3, the supporting roller 33 is made from magnetic material. A magnetic flux generator 34 is disposed facing the supporting roller 33. The magnetic flux generator 34 works as an induction heating unit and the magnetic field made by the magnetic flux generator 34 provokes heat in the supporting roller 33 which heats toner images on the image transferring-and-fixing belt 121. Other elements work the same way as elements shown in FIG. 1 and FIG. 2. An element indicated by an indication number works the same way as an element in FIG. 1 and FIG. 2 indicated by the same indication number.

The image forming apparatus in FIG. 3 shows the same good feature as shown in the image forming apparatus in FIG. 1.

Figure 4:
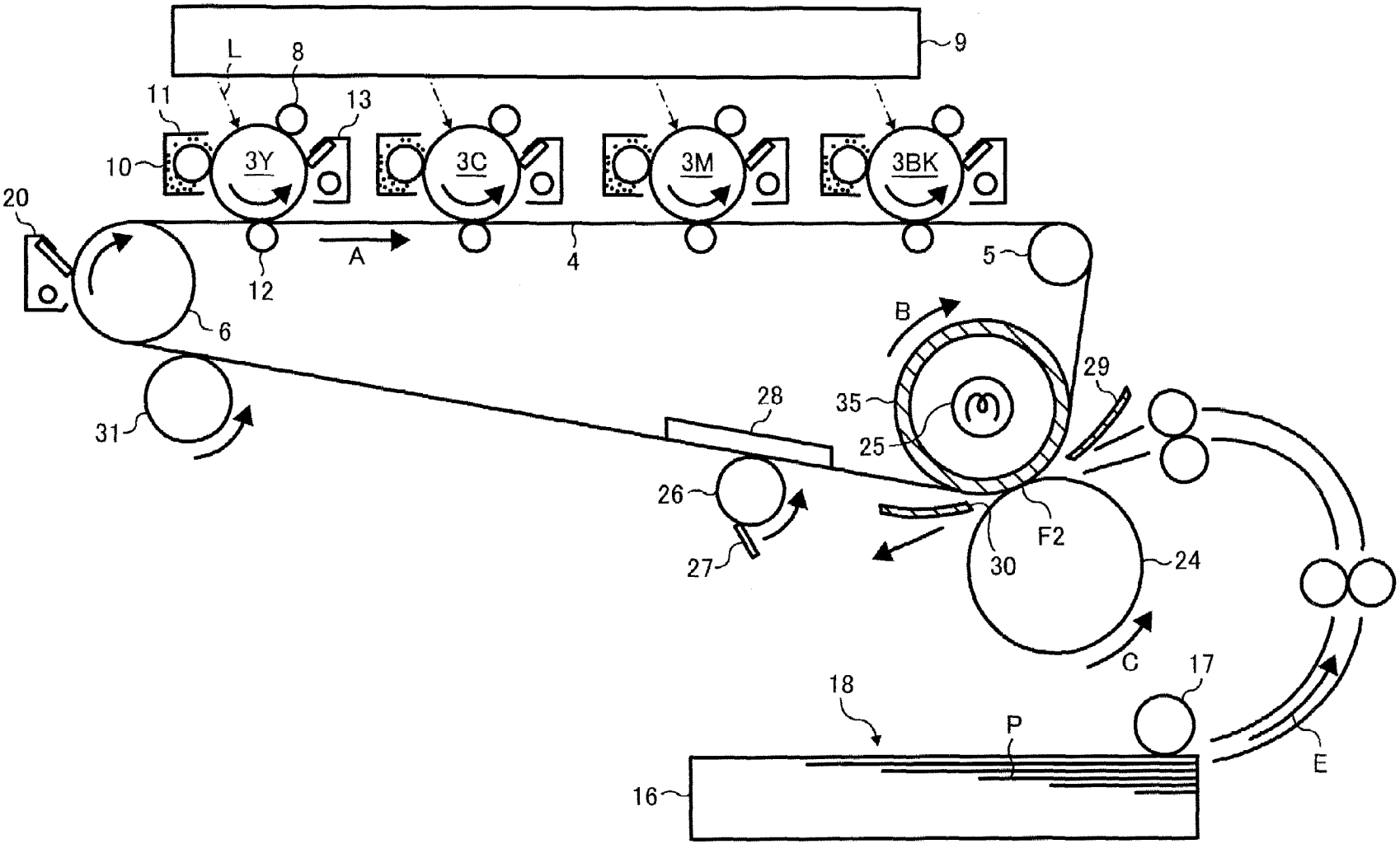
FIG. 4 shows a cross section of another embodiment of an image forming apparatus.

An image forming apparatus shown in FIG. 4 does not include an image transferring-and-fixing body such as the image transferring-and-fixing roller 21 or the image transferring-and-fixing belt 121. Instead, an intermediate transfer belt 4 is spanned by a heating roller 35 and the rollers 5 and 6, and driven to rotate in the direction of an arrow A. The heating roller 35 is implemented as a metal pipe such as aluminum and driven to rotate in the direction of an arrow B. A heater 25 is disposed within the heating roller 35. A pressure roller 24 is directly pressed to the intermediate transfer belt 4, being driven to rotate in the direction of an arrow C in FIG. 4. A halogen heater or other heaters can be used as the heater 25.

Toner images on each photoconductor 3Y, 3C, 3M and 3BK corresponding to each color are transferred to the intermediate transfer belt 4 superimposing on each other to form color toner images. Full color toner images on the intermediate belt 4 are heated by the heater 25 and are softened. A paper P fed from a sheet feed cassette 18 moves through between the intermediate transfer belt 4 and the pressure roller 24 and toner images on the intermediate transfer belt 4 are transferred and fixed to the paper P. The residual toner particles remaining on the intermediate transfer belt 4 are removed by a cleaner implemented as a cleaning roller 26 rotating in the direction of an arrow in FIG. 4.

As a summary, the image forming apparatus in FIG. 4 includes photoconductor 3Y, 3C, 3M and 3BK, the developing device 10 to develop latent images to toner images, the intermediate transfer belt 4 to which toner images are transferred from the photoconductors, the heater 25 to heat toner images on the intermediate transfer belt 4 and the pressure roller 24 being pressed to the intermediate transfer belt 4. And toner images on the intermediate transfer belt 4 are heated by the heater 24, transferred to a paper P being fixed simultaneously and removed by the cleaning roller 26 after transfer process. Other elements work the same way as elements shown in FIG. 1. An element indicated by an indication number works the same way as an element in FIG. 1 indicated by the same indication number. Since the cleaning roller 26 is provided, a cleaner 20 can be omitted.

Toner particles used in the image forming apparatus in FIG. 4 are the same toner particles used in the image forming apparatus in FIG. 1. Therefore, "toner filming" can be improved by lowering the temperature of the intermediate transfer belt 4 after transfer process to a paper P at the position F2 and, therefore, by reduce the heat transfer from the intermediate transfer belt 4 to the photoconductors. Besides, the residual toner particles can be effectively removed by the cleaning roller 26 in spite of the thermal decline of the intermediate transfer belt 4. Therefore, high quality images can be formed on papers.

Although it is explained that other elements in the image forming apparatus in FIG. 4 are the same elements as in FIG. 1, the important elements will be explained below for confirmation.

It is preferable to design a temperature "tf" and "tc" and the storage elastic modulus of toner particles "Gr(tf)" and "Gl (tc)" to satisfy following relation.

$$tf-30(^\circ\text{ C.})>tc(^\circ\text{ C.})$$

$$Gl(tc)/Gr(tf)<10$$

It is preferable to design toner particles so that Gr(tf) and Gl(tc) satisfy following relations.

$$5\times10^2\text{ [Pa]}<Gr(tf)<1\times10^4\text{ [Pa]}$$

$$1\times10^3\text{ [Pa]}<Gl(tc)<5\times10^4\text{ [Pa]}$$

Here, $10^n$ is the n-th power of 10.

It is preferable to provide the heat pipe 28 and the cooling roller 31 at the upstream of the positions at which toner particles on the photoconductors are transferred to the intermediate transfer belt 4 and the downstream of the position F2.

Each one of these two coolers can independently reduce the heat transfer to the intermediate transfer belt 4 all of these coolers can reduce the heat transfer to the intermediate transfer belt 4 at the same time. Or, it is possible to cool the intermediate transfer belt 4 by the cleaning roller 26 without any of the cooling roller 31 and the heat pipe 28.

Figure 5:
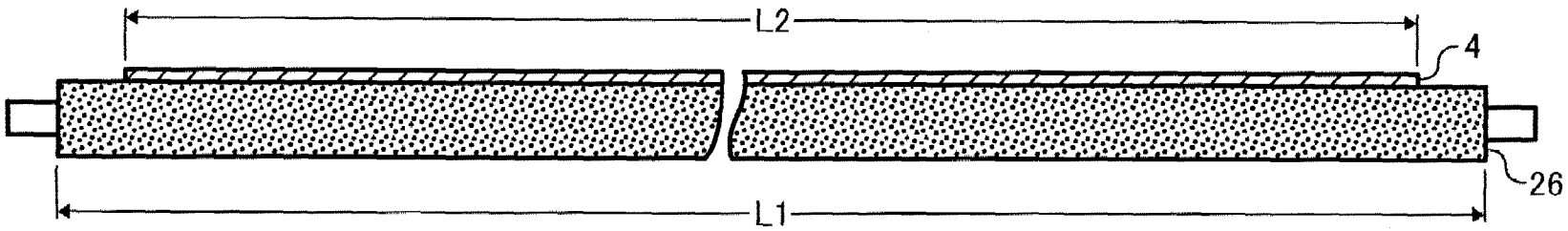
FIG. 5 shows one embodiment of how the transferring-and-fixing belt contacts a cleaning roller.

It is preferable that fine convexes and concaves are formed on the surface of the cleaning roller 26. Moreover, it is preferable to arrange L1 to be greater than L2. Here, L1 is a widthwise length of the cleaning roller 26. L2 is a widthwise length of the intermediate transfer belt 4 as shown in FIG. 5. The widthwise length is a length in a direction perpendicular to a direction that the intermediate transfer belt 4 moves.

Next, a procedure to measure the storage elastic modulus of toner particles used in above-mentioned embodiments will be explained.

The measurement was conducted by means of a viscoelasticity meter (Rheogel-E4000, UBM). Toner particles at the temperature 25° C. are provided being contained in a parallel plate of 20 mm in diameter and 2.0+/−0.3 mm in thickness.

Measurement of viscoelasticity is performed under the following condition.

[Measurement Conditions]

(1) Parallel plate of 20 mm in diameter is prepared as an experimental material.

(2) Measurement is set at a strain of 1.5 μm, at a frequency of 10 Hz (sine waveform) and at a load of 2 Kg.

(3) Measurement temperature is increased with a ramp rate of 2.0° C./min from 30° C. to 200° C.

Thus, a flow starting temperature of toner particles is measured.

(4) New parallel plate of 20 mm in diameter is prepared and set into the viscoelasticity meter whose internal temperature is smaller than 30° C. A strain value is the same as explained in (2).

(5) Measurement temperature is increased with a ramp rate of 2.0° C./min from 30° C. to (the flow starting temperature −10) ° C. in order to measure the value Gr. After an interval of 5 minutes at the temperature of (the flow starting temperature −10) ° C., measurement temperature is decreased with a ramp rate of 2.0° C./min to 30° C. in order to measure the value Gl. Here, the viscoelasticity meter is controlled so that the load is released when the thickness of experimental material is compressed to 90%.

It is preferable that toner particles include plasticizer which is compatible with resin of toner particles when heated. The plasticizer helps toner particles to be fixed to a paper at low temperature.

Similarly, it is preferable that toner particles include crystalline polyester resin which is compatible with resin of toner particles when heated. The crystalline polyester resin helps toner particles to be fixed to a paper at low temperature.

It is preferable to use toner particles prepared by the suspension polymerization method. Toner particles prepared by the suspension polymerization method can be obtained by emulsifying and/or dispersing a solution and/or dispersion liquid (suspension liquid) of toner component in an aqueous medium followed by granulating toner particles.

In the suspension polymerization method, toner material does not have to be heated to high temperature like a pulverization method in which toner material is kneaded at high temperature. Therefore, toner particles can be obtained without making compositions being mixed with each other and therefore the feature of toner particles shown in FIG. 6 is obtained more easily.

Next, details of toner particles will be explained.

As a binder resin used in toner particles of the invention, those having the following compositions can be used according to the target feature of toner particles as long as they satisfy the relation Gr>Gl.

Examples thereof include homopolymers of styrene or substituted styrene such as polyester, polystyrene, poly-p-chlorostyrene and polyvinyltoluene; and styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-alpha-chloromethacrylate copolymer, styrene-acrylonitrile copolymer, styrene-vinylmethyl ether copolymer, styrene-vinylethyl ether copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer.

Further, the following resins can be used by mixture. Examples include polymethylmethacrylate, polybutylmethacrylate, polyvinyl chloride, polyvinyl acetate, polyethylene, polypropylene, polyurethanes, polyamides, epoxy resins, polyvinylbutylal, polyacrylic acid resins, rosin, modified rosin, terpene resins, phenol resin, aliphatic or alicyclic hydrocarbon resins, aromatic petroleum resins, chlorinated paraffin, paraffin wax, and the like.

Among these, polyester resin is particularly preferred in order to obtain satisfactory image-fixing properties. The polyester resin can be obtained by condensation polymerization of alcohol and carboxylic acid, and examples of the alcohol for use include diols such as polyethyleneglycol, diethyleneglycol, triethyleneglycol, 1,2-propylene glycol, 1,3-propylene glycol, 1,4-butane diol, neopentyl glycol, 1,4-butene diol; etherified bisphenols such as 1,4-bis(hydroxylmethyl)cyclohexane, bis-phenol A, hydrogenated bisphenol A, polyoxy-ethylenated bisphenol A, polyoxy-propylenated bisphenol A, divalent alcohols in which these are substituted with saturated or unsaturated hydrocarbon groups having a carbon number of 3 to 22, and other divalent alcohols.

Examples of the carboxylic acid for use in order to obtain the polyester resin include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, divalent organic acid monomers in which these are substituted with saturated or unsaturated hydrocarbon groups having a carbon number of 3 to 22, and acid anhydride thereof, dimmer of lower alkylester and linolenic acid; and other divalent organic acid monomers.

In order to obtain the polyester resin used as a binder resin, not only polymers composed of the above-mentioned difunctional monomers, but also polymers containing components of polyfunctional monomers having three or more functionalities are suitably used. Examples of a polyhydric alcohol monomer three or more functionalities is polyfunctional monomer, include sorbitol, 1,2,3,6-hexanetetrol, 1,4-sorbitan, pentaerythritol, di-pentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethyl benzene, and the like Examples of tricarboxylic or more polycarboxylic acid monomer include 1,2,4-benzenetricarboxylic acid, 1,2,5-benzene tricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylic-propane, tetra(methylenecarboxylic) methane, 1,2,7,8-octane tetracarboxylic acid, empol trimer acid, and acid anhydride thereof, and the like.

As mentioned above, crystalline polyester resin is compatible with resin of toner particles when heated. The glass transition temperature is preferably not smaller than 60° C. and smaller than 140° C. If the glass transition temperature is smaller than 60° C., it is difficult for toner particles to keep the heatproof property under environmental heat because it is difficult to prevent compositions in toner particles from being mixed with each other. On the other hand, if the glass transition temperature is not smaller than 140° C., it is difficult to effectively mix compositions in toner particles under the fixing process and therefore it is difficult to change the storage elastic modulus of toner particles effectively.

If toner particles are prepared by the pulverization method, the heatproof property of toner particles tends to decline because of mixture of components even if the kneading condition is adjusted carefully. Therefore, the glass transition temperature of the crystalline polyester resin is preferably greater than 10° C.

The crystalline polyester resin includes a structure represented by the following formula (1):

$$—OCOC—R—COO—(CH2)n- \quad (1)$$

(wherein R represents a linear unsaturated aliphatic group having from 2 to 20 carbon atoms, and n is an integer of from 2 to 20), in an amount of at least 60% by mole based on the total ester bonds. In formula (1), R is preferably a linear divalent unsaturated carboxylic acid residual group having from 2 to 20 carbon atoms, and is more preferably a linear unsaturated aliphatic group having from 2 to 4 carbon atoms. The number n is preferably an integer of from 2 to 6.

Specific examples of the linear unsaturated aliphatic group mentioned above include linear unsaturated aliphatic groups which are derived from linear unsaturated dibasic carboxylic acids such as maleic acid, fumaric acid, 1,3-n-propenedicarboxylic acid, 1,4-n-butenedicarboxylic acid, etc.

The group —(CH2)n- is a residual group of a linear dihydric aliphatic alcohol. Specific examples of the linear dihydric aliphatic alcohols include ethylene glycol, 1,3-propylene glycol, 1,4-butanediol, 1,6-hexanediol etc. Since a linear unsaturated aliphatic dicarboxylic acid is used as the carboxylic acid component, polyester resins having a crystalline structure can be easily prepared compared to a case where an aromatic dicarboxylic acid is used as the carboxylic acid component.

The crystalline polyester resins for use in toner particles can be produced by subjecting the following components (1) and (2) to a polycondensation reaction.

(1) polycarboxylic acids such as linear unsaturated aliphatic dicarboxylic acids or their reactive derivatives (such as anhydrides, alkyl (C1 to C4) esters and acid halides thereof); and (2) polyhydric alcohols such as linear aliphatic diols.

In this regard, a small amount of the following polycarboxylic acids can be used in combination with the polycarboxylic acids (1).

(1)-1) branched unsaturated aliphatic dicarboxylic acids;

(1)-2) saturated aliphatic polycarboxylic acids such as saturated aliphatic dicarboxylic acids and saturated aliphatic tricarboxylic acids; and (1)-3) aromatic polycarboxylic acids such as aromatic dicarboxylic acids and aromatic tricarboxylic acids.

These polycarboxylic acids (1)-1) to (1)-3) can be used in an amount such that the resultant polyester resin does not lose the crystallinity. Specifically, the added amount is generally not greater than 30% by mole, and preferably not greater than 10% by mole, based on the total amount of the carboxylic acids used for toner particles.

Specific examples of such polycarboxylic acids (1)-1) to (1)-3) include dicarboxylic acids such as malonic acid, succinic acid, glutaric acid, adipic acid, suberic acid, sebacic acid, citraconic acid, phthalic acid, isophthalic acid, and terephthalic acid; and tri- or more-carboxylic acids such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid.

In addition, a small amount of polyhydric alcohols such as branched dihydric alcohols, cyclic dihydric alcohols, and tri- or more-hydric alcohols can be used in combination with the above-mentioned polyhydric alcohols (2) such that the resultant polyester resin does not lose the crystallinity.

Specific examples of such polyhydric alcohols include 1,4-bis(hydroxymethyl)cyclohexane, polyethylene glycol, ethylene oxide adducts of bisphenol A, propylene oxide adducts of bisphenol A, glycerin etc. The added amount is generally not greater than 30% by mole, and preferably not greater than 10% by mole, based on the total amount of the alcohols used for the toner.

The crystalline polyester resin included in the toner preferably has a relatively low molecular weight and a sharp molecular weight distribution to impart good low temperature fixability to the toner. Specifically the crystalline polyester resin preferably has a weight average molecular weight (Mw) of from 5,500 to 6,500 by molecular weight distribution by gel permeation chromatography (GPC) for portions soluble in o-dichlorobenzol, a number average molecular weight (Mn) of from 1,300 to 1,500 and a Mw/Mn ratio of from 2 to 5.

As mentioned above, the plasticizer is preferably compatible with the resin when heated. In one embodiment the plasticizer is soluble and/or miscible with the resin when heated.

When the resin and the plasticizer are present as particles of resin and particles of plasticizer, e.g., independently existent, meaning that both are not in a compatible state, good heat-resistant preservability thereof is desired. When the resin and the plasticizer are heated during fixing, the resin and the plasticizer are desired to be rapidly dissolved to each other to obtain a high level of low temperature fixability. Therefore, the melting point (Tm) of the plasticizer is preferably not smaller than 50° C. and lower than 120° C. and more preferably not smaller than 60° C. and lower than 100° C. When the melting point Tm is too low, heat-resistant preservability thereof may be inferior. When the melting point Tm is too high, the low temperature fixability may be inferior and the compatibility between the resin and the plasticizer tends to be insufficient, under fixing process. Therefore, it is difficult to change the storage elastic modulus of toner particles effectively.

There is no specific limit to the selection of the plasticizers. The plasticizers can be suitably selected to the purpose and specific examples thereof include esters of an aliphatic acid, esters of an aromatic acid such as phthalic acid, esters of phosphoric acid, esters of maleic acid, esters of fumaric acid, esters of itaconic acid, ketones such as benzoin compounds, and benzoil compounds, hindered phenol compounds, benzotriazol compounds, aromatic sulfonamide compounds, aliphatic amide compounds, long-chain alcohols, long-chain di-alcohols, long-chain carboxylic acids, and long-chain dicarboxylic acids.

Specific examples thereof include dimethyl fumarate, monoethyl fumarate, monobutyl fumarate, monomethyl itaconate, monobutyl itaconate, diphenyl adipate, dibenzyl terephthalate, di-benzoil isophthalate, benzil, benzoin isopropyl ether, 4-benzoil biphenyl, 4-benzoil diphenyl ether, 2-benzoil naphthalene, dibenzoil methane, 4-biphenyl carboxylic acid, stearyl stearic acid amide, oleyl stearic acid amide, stearic oleic acid amide, octadecanol, n-octyl alcohol, tetracosanic acid, tetracosanoic acid, eicosanic acid, stearic acid, lauric acid, nonadecanoic acid, palmitic acid hydroxy octanic acid, docosaconic acid, and the compounds of chemical formulae (1) to (17) illustrated in JOP 2002-105414, incorporated herein by reference in its entirety.

The plasticizer is preferably contained in toner in a dispersion state. The dispersion particle diameter of the plasticizer is, for example, preferably from 10 nm to 3 μm and more preferably from 50 nm to 1 μm in the longitudinal direction.

When the dispersion particle diameter of the plasticizer is too small, its heat-resistant preservability tends to deteriorate due to the increase in the contact area between the plasticizer and the resin. When the dispersion particle diameter of the plasticizer is too large, its low temperature fixability may deteriorate since the plasticizer may not be sufficiently compatible with the resin when heated during fixing.

There is no specific limit to the measuring method to the dispersion particle diameter of the plasticizer. The measuring method can be selected to purposes. An example method is as follows:

Embed toner in an epoxy resin and obtain an extremely thin piece having a thickness of about 100 nm;

Dye the piece with ruthenium tetroxide;

Observe the dyed piece with transmission electron microscope (TEM) with a magnifying power of 10,000;

Take a photograph thereof;

and observe the dispersion state of the plasticizer in the particle by evaluating the photograph for image to measure the dispersion diameter.

When the dispersion body of the plasticizer is confirmed to be present in the particle, the state of the plasticizer is determined that the plasticizer is not contained in toner in a manner in which the plasticizer and the resin are dissolved in each other and the plasticizer is dispersed at molecular level.

With regard to the solubility of the plasticizer, it is preferred that the solubility is not greater than 1 weight % and more preferably not greater than 0.1 weight % in an organic solvent at a temperature not higher than 25° C. When the solubility is too large, the resin and the plasticizer may be dissolved in each other during toner manufacturing when the method of manufacturing toner, which is described later, is used.

In addition, it is preferred that the solubility is not less than 5 weight % and more preferably not less than 20 weight % in an organic solvent at a temperature not lower than 60° C. When the solubility is too small, the plasticizer may not be dissolved in the organic solvent mentioned above when heated, which leads to deterioration of the dispersion state of the plasticizer in toner.

The solubility of the plasticizer in the organic solvent can be obtained by measuring the dissolved amount of the plasticizer based on 100 g of the organic solvent mentioned above at each measuring temperature.

The content of the plasticizer in toner is preferably from 5 to 30 weight % and more preferably from 10 to 20 weight % in terms of a good combination of the low temperature fixability and heat-resistant preservability and maintaining high level toner characteristics such as chargeability and resolution. When the content is too small, the low temperature fixability may deteriorate. When the content is too large, the area of the plasticizer on the surface of a toner particle tends to increase, resulting in deterioration of fluidity of the toner.

There is no specific limit to the other components mentioned above. Therefore, such other components can be selected based on the desired purpose. Specific examples thereof include colorants, waxes, charge control agents, inorganic particulates, fluidity improvers, cleaning improvers, magnetic materials and metal soaps.

There is no specific limit to such colorants. Known dyes and pigments can be selected to purpose.

Specific examples thereof include carbon black, Nigrosine dyes, black iron oxide, yellow dyes, magenta dyes, and cyan dyes. Specific examples of such yellow dyes include condensation azo compounds, isoindolinone compounds, anthraquinone compounds, azo metal complexes, methylene compounds, and allylamide compounds. More specific examples of such yellow dyes include Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow. Specific examples of such magenta dyes include condensation azo compounds, diketopyrolo-pyrole compounds, anthraquinone compounds, quinacridone compounds, basic dye lake compounds, naphthol compounds, benzimidazolone compounds, thioindigo compounds, and perylene compounds. More specific examples of such magenta dyes include red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange. Specific cyan dyes include copper phthalocyanine compounds and their derivatives, anthraquinone compounds, basic dye lake compounds. More specific examples of such cyan dyes include cobalt blue, cerulean blue, Alkali Blue Lake, Peacock Blue Lake, Victoria Blue Lake, metal-free Phthalocyanine Blue, Phthalocyanine Blue, Fast Sky Blue, INDATHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone.

These materials can be used alone or in combination.

There is no specific limit to the content of such a colorant. The content thereof can be suitably selected to purpose but is preferably from 1 to 15 weight % and more preferably from 3 to 10 weight %. When the content of such a colorant is too small, the coloring ability of toner containing the colorant may deteriorate. When the content thereof is too large, the dye may be not sufficiently dispersed in toner, which leads to deterioration of the coloring ability and the electric characteristics of the toner.

The colorant can be used as a master batch mixed with a resin. There is no specific limit to such a resin. Known resins can be suitably selected to purpose. Specific examples thereof include styrene, polymers of substitution products thereof, styrene based copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic resins, rhodine, modified rhodines, terpene resins, aliphatic hydrocarbon resins, aromatic petroleum resins, chlorinated paraffin, and paraffin waxes. These can be used alone or in combination.

Specific examples of the styrenes and polymers of substitution products thereof include polyester resins, polystyrenes, poly-p-chlorostyrene, and polyvinyltoluene. Specific examples of the styrene based copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batch mentioned above can be typically prepared by mixing and kneading the resin for use in the master batch and the colorant upon application of high shear stress thereto. It is preferred that an organic solvent is used to boost the interaction between the colorant and the resin. In addition, a flushing method is preferred because the resultant wet cake of the colorant can be used as it is without drying. In such a flushing method, an aqueous paste including a colorant is mixed or kneaded with a resin solution of an organic solvent to transfer the colorant to the resin solution and remove the aqueous liquid and organic solvent component. In this case, a high shear stress dispersion device such as a three-roll mill is preferably used for mixing or kneading.

There is no specific limit to the waxes mentioned above. The waxes can be suitably selected to purpose. It is preferred to use a wax having a low melting point, i.e., from 50° C. to 120° C., since waxes having a low melting point effectively function between a fixing roller and the surface boundary of toner when dispersed with the resin. Therefore, such a wax having a low melting point has a good anti-hot offset property even for an oil-less fixing, in which a wax such as oil is not applied to a fixing roller.

Specific examples of such waxes include natural waxes such as plant waxes such as carnauba wax, cotton wax, haze wax, and rice wax, animal waxes such as yellow bees wax and lanoline, mineral waxes such as ozokerite and petroleum waxes such as paraffin, microcrystalline wax and petrolatum. Other than these natural waxes, synthetic hydrocarbon waxes such as Fisher-Tropsch wax and polyethylene wax, and synthetic waxes such as esters, ketones, and ethers can be used. Further, fatty acid amides such as 1,2-hydroxystearic acid amide, stearic acid amides, anhydrous phthalic acid imides and chlorinated hydrocarbons, homo polymers or copolymers (e.g., copolymers of n-stearyl acrylate-ethylmethacrylate) of a polyacrylate, which is a crystalline polymer resin having a relatively low molecular weight, such as poly-n-stearyl methacrylate and poly-n-lauric methacrylate, and crystalline polymers having a long chain alkyl group on its branched chain can be also used. These can be used alone or in combination.

There is no specific limit to the melting point of the waxes mentioned above. The melting point can be suitably selected to purpose. It is preferred that the melting point is from 50 to 120° C. and more preferably from 60 to 90° C.

When the melting point is too low, wax may have an adverse impact on heat-resistant preservability. When the melting point is too high, cold offset tends to occur at low temperature fixing.

Melt viscosity of the waxes mentioned above is preferably from 5 to 1,000 cps and more preferably from 10 to 100 cps when measured at a temperature 20° C. higher than the melting point of the wax mentioned above.

When the melting viscosity thereof is too small, the releasability may deteriorate. When the melting viscosity thereof is too large, the effect of the wax to improve anti-hot offset property and low temperature fixability may be insufficient.

There is no specific limit to the content of the wax mentioned above contained in toner particles mentioned above. It is possible to suitably select any content to purpose. The content is preferably from 0 to 40 weight % and more preferably from 3 to 30 weight %. When the content is too large, the fluidity of the toner easily deteriorates.

There is no specific limit to the charge control agent mentioned above. Any known charge control agents can be suitably selected to purpose. Specific examples of the charge control agents include nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphorous and compounds including phosphorous, tungsten and compounds including tungsten, fluorine-containing activators, metal salts of salicylic acid, metal salts of salicylic acid derivatives, etc. These can be used alone or in combination.

Marketed products of the charge control agents can be also used and specific examples thereof include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge control agent is not particularly limited because the content is determined depending on the species of the kind of the resin mentioned above, whether or not an additive is added, and toner manufacturing method (such as dispersion method) used. However, the content of the charge control agent is preferably from 0.1 to 10 parts by weight, and more preferably from 0.2 to 5 parts by weight, per 100 parts by weight of the binder resin contained in the toner.

When the content is too small, good charge controllability may not be obtained. When the content is too high, the toner has too large a charge quantity, and thereby the electrostatic force of the two-component developer carrier attracting the toner increases, resulting in deterioration of the fluidity of the toner and decrease of the image density of toner images.

The inorganic particulates mentioned above can be used as an additive to impart fluidity, developability and chargeability to toner particles.

There is no specific limit to the inorganic particulates. It is possible to suitably select any known inorganic particulate to purpose. Specific examples thereof include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

It is preferred that the inorganic particulate should have a primary particle diameter of from 5 nm to 2 μm, and more preferably from 5 nm to 500 nm. In addition, it is preferred that the specific surface area of such an inorganic particulate measured by a BET method is from 20 to 500 m2/g.

The content of the inorganic particulate in the toner mentioned above is preferably from 0.01 to 5% by weight, and more preferably from 0.01 to 2.0% by weight, based on the total weight of the toner.

The fluidity improvers mentioned above represent materials which have been subject to a surface treatment to improve their hydrophobic nature, thereby maintaining the fluidity and chargeability even under high humidity conditions. Specific examples thereof include silane coupling agents, silylation agents, silane coupling agents including a fluoroalkyl group, organic titanate coupling agents, aluminum coupling agents, silicone oils, modified silicone oils, etc. Silica and titanium oxide are preferably surface-treated by such a fluidity improver and used as hydrophobic silica and hydrophobic titanium oxide.

The cleaning improver is preferably added to toner particles to remove developer remaining on the photoconductors or the intermediate transfer belt or the like. Specific examples thereof include fatty acid metal salts such as zinc stearate, calcium stearate, and stearic acid and polymer particulates such as polymethyl methacrylate particulates and polystyrene particulates prepared by a soap-free emulsification polymerization method. The polymer particulates preferably have a relatively narrow particle size distribution. Its volume average particle diameter is preferably from 0.01 to 1 μm.

There is no specific limit to the magnetic materials mentioned above. Any known magnetic materials can be suitably selected to purpose. Specific examples of the magnetic materials include iron powders, magnetite, ferrite etc. Within these materials, white-colored material is preferable in view of color tone.

Toner particles can be prepared by known methods such as a suspension polymerization method, an emulsification polymerization method, and dissolution suspension method. For example, toner particles can be obtained by emulsifying or dispersing a solution or dispersion liquid of a toner component in an aqueous material to prepare an emulsification or dispersion liquid followed by granulation of toner particles.

Suitably preferred toner is toner obtained as follows: Emulsify or disperse a toner component at least containing a compound having an active hydrogen and a polymer reactive with the active hydrogen in an aqueous medium; and react the compound having an active hydrogen and the polymer reactive in the aqueous medium to produce particles at least having adhesive base materials.

The temperature at which toner particles are manufactured is preferably from 10 to 100° C. and more preferably from 20 to 60° C. When the temperature for manufacturing toner particles is too high, the resin and the plasticizer therein tend to be dissolved in each other upon application of heat and it may be difficult to have a good combination of low temperature fixability and heat-resistant preservability.

Below are the descriptions of a preferred embodiment of toner particles.

---Solution or Dispersion Liquid of Toner Component---

The solution or dispersion liquid of the toner component is prepared by dissolving or dispersing the toner component mentioned above in a solvent.

There is no specific limit to the toner component as long as toner particles can be granulated. It is possible to suitably select any toner component to purpose. For example, such a toner component contains at least one of a compound having an active hydrogen group and polymer (prepolymer) reactive therewith, preferably the plasticizer mentioned above, and the other components mentioned above such as non-modified polyester resins, waxes, colorants and charge control agents, if desired.

The solution and the dispersion liquid of a toner component is preferred to be prepared by dissolving or dispersing the toner component mentioned above in the organic solvent mentioned above. The organic solvent is preferably removed during or after granulating toner particles.

There is no specific limit to the organic solvent as long as the toner component can be dissolved or dispersed therein. It is possible to suitably select any organic solvent to purpose. For example, a volatile organic solvent having a boiling point not higher than 150° C. is preferred in terms of removal. Specific examples of such organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. Among them an ester based solvent is preferred and ethyl acetate is particularly preferred. These can be used alone or in combination.

There is no specific limit to the addition quantity of such an organic solvent. It is possible to suitably select any addition quantity to purpose. For example, the addition quantity is preferably from 40 to 300 parts by weight, more preferably from 60 to 140 parts by weight, and further preferably from 80 to 120 parts by weight, per 100 parts by weight of the toner component.

In addition, in the method of preparing preferred toner particles, a solution or dispersion liquid of the toner component can be prepared by dissolving or dispersing materials such as a compound having an active hydrogen group, a polymer reactive therewith, a non-modified polyester resin, a wax, a colorant, and a charge control agent in the organic solvent. Among the toner components mentioned above, the components other than the polymer (prepolymer) reactive with the compound having an active hydrogen group can be admixed in an aqueous medium during preparation of an aqueous medium described later, or added to an aqueous medium together with a solution or dispersion liquid of the toner component when the solution or the dispersion liquid is added to the aqueous medium.

---The Compound Having an Active Hydrogen Group---

The compound having an active hydrogen group functions as an elongation agent or cross-linking agent when the compound having an active hydrogen group and a polymer reactive therewith perform elongation reaction, cross linking reaction, etc., in an aqueous medium.

There is no specific limit to the compound having an active hydrogen group as long as the compound has an active hydrogen group therein. It is possible to suitably select any compound to purpose. For example, when a polymer reactive with a compound having an active hydrogen group is a polyester prepolymer having an isocyanate group (A), amines (B) are preferred considering that these amines can perform reactions such as elongation reaction and cross linking reaction with the polyester prepolymer having an isocyanate group to obtain a resultant polymer having a large molecular weight.

There is no specific limit to the active hydrogen group and it is possible to select any group containing an active hydrogen based on the desired purpose. Specific examples of such active hydrogen groups include hydroxyl group (alcohol hydroxyl group and phenol hydroxyl group), amino group, carboxyl group and mercapto group. These groups can be used alone or in combination. Among them, alcohol hydroxyl group is especially preferred.

There is no specific limit to the amines (B) mentioned above and it is possible to suitably select them to purpose. Specific examples of the amines (B) include diamines (B1), polyamines having three or more amino groups (B2), amino alcohols (B3), aminomercaptans (B4), amino acids (B5), and blocked amines (B6), in which the amines (B1-B5) mentioned above are blocked. These can be used alone or in combination. Among these, diamines (B1) and a mixture in which a diamine (B1) is mixed with a small amount of a polyamine having three or more amino groups (B2) are particularly preferred.

Specific examples of the diamines (B1) include aromatic diamines, alicyclic diamines and aliphatic diamines. Specific examples of the aromatic diamines include phenylene diamine, diethyltoluene diamine and 4,4'-diaminodiphenyl methane. Specific examples of alicyclic diamines include 4,4'-diamino-3,3'-dimethyldicyclohexyl methane, diaminocyclohexane and isophoron diamine. Specific examples of aliphatic diamines include ethylene diamine, tetramethylene diamine and hexamethylene diamine.

Specific examples of the polyamines having three or more amino groups (B2) include diethylene triamine, and triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) in which the amino group of B1 to B5 mentioned above is blocked include ketimine compounds which are prepared by reacting one of the amines (B1)-(B5) mentioned above with a ketone such as acetone, methyl ethyl ketone and methyl isobutyl ketone and oxazolizone compounds.

The elongation reaction and the cross linking reaction between the compound having an active hydrogen group and the polymer reactive therewith can be controlled by a molecular-weight control agent. Such a molecular-weight control agent is preferably used because the molecular weight, etc., of the adhesive base material mentioned above can be controlled within a desired range.

Specific preferred examples of the molecular-weight control agent include monoamines (e.g., diethyl amine, dibutyl amine, butyl amine and lauryl amine), and blocked amines (i.e., ketimine compounds) prepared by blocking the monoamines mentioned above.

The mixing ratio of the amines (B) to the prepolymer (A) having an isocyanate group, i.e., the mixing equivalent ratio ([NCO]/[NHx]) of the isocyanate group [NCO] contained in the prepolymer (A) having an isocyanate group to the amino group [NHx] contained in the amines (B), is preferably from 1/3 to 3, more preferably from 1/2 to 2 and particularly preferably from 1/1.5 to 1.5.

When the mixing ratio is too low, the low temperature fixability tends to deteriorate. When the mixing ratio is too large, the molecular weight of the urea modified polyester may decrease, resulting in deterioration of anti-hot offset property.

---Polymer Reactive with Compound Having an Active Hydrogen Group---

There is no specific limit to the polymer (hereinafter occasionally referred to as prepolymer) reactive with a compound having an active hydrogen group as long as the polymer has a portion reactive with the compound having an active hydrogen group. It is possible to suitably select any known resin. For example, polyol resins, polyacrylic resins, polyester resins, epoxy resins, and their derivative resins can be used.

These can be used alone or in combination. Among these, polyester resins are particularly preferred in terms of high fluidity and transparency when fused.

There is no specific limit to the portion in the prepolymer mentioned above reactive to a compound having an active hydrogen group. It is possible to suitably select any among known substituents, etc., to purpose. For example, isocyanate group, epoxy group, carboxylic acid, an acid chloride group can be mentioned.

These can be used alone or in combination. Among these, isocyanate group is particularly preferred.

Among these prepolymers mentioned above, a polyester resin (RMPE) having a urea linkage producing group is particularly preferred because such a prepolymer can easily control the molecular weight of the polymer component and secure oil-less low temperature fixability, especially good releasability and fixability even when a mechanism to provide release oil to a heating medium for fixing is not provided.

An example of the urea linkage producing group is isocyanate group. When the urea linkage producing group in the polyester resin (RMPE) having a urea linkage producing group is isocyanate group, the polyester prepolymer (A) having an isocyanate group is a suitable example for the polyester resin (RMPE).

There is no specific limit to the polyester prepolymer (A) having an isocyanate group. It is possible to suitably select any polyester prepolymer (A) to purpose. A specific example of the polyester prepolymers (A) is polyester prepared by reacting with a polyisocyanate (PIC) polyester having an active hydrogen group which is a polycondensation compound of a polyol and a polycarboxylic acid.

There is no specific limit to the polyols (PO) mentioned above. It is possible to suitably select any polyol to purpose. Suitable polyols (PO) include diols (DIO) and polyols (TO) having three or more hydroxyl groups, and a mixture in which a diol (DIO) is mixed with a polyol (TO) having three or more hydroxyl groups. These can be used alone or in combination. Among these, a simple diol (DIO) or a mixture in which a diol (DIO) is mixed with a polyol (TO) having three or more hydroxyl groups is preferred.

Specific examples of the diols (DIO) include alkylene glycol, alkylene ether glycols, alicyclic diols, adducts of the alicyclic diols with an alkylene oxide, bisphenols and adducts of the bisphenols mentioned above with an alkylene oxide.

Suitably preferred alkylene glycols have 2 to 12 carbon atoms and their specific examples include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the adducts of the alicyclic diols with an alkylene oxide include compounds in which an alkylene oxide such as ethylene oxide, propylene oxide and butylene oxide is adducted to the alicyclic diols mentioned above. Specific examples of the bisphenols include bisphenol A, bisphenol F and bisphenol S. Specific examples of the adducts of the bisphenols with an alkylene oxide include compounds in which an alkylene oxide such as ethylene oxide, propylene oxide and butylene oxide is adducted to the bisphenols mentioned above.

Among these compounds, alkylene glycols having from 2 to 12 carbon atoms and adducts of a bisphenol with an alkylene oxide are preferred. Adducts of a bisphenol with an alkylene oxide, or mixtures of an adduct of a bisphenol with an alkylene oxide and an alkylene glycol having from 2 to 12 carbon atoms are particularly preferred.

Suitably preferred polyols (TO) having three or more hydroxyl groups have three to eight hydroxyl groups. Specific examples thereof include aliphatic alcohols having three or more hydroxyl groups, and polyphenols having three or more hydroxyl groups and adducts of a polyphenol having three or more hydroxyl groups with an alkylene oxide.

Specific examples of the aliphatic alcohols having three or more hydroxyl groups include glycerin, trimethylol ethane, trimethylol propane, pentaerythritol and sorbitol. Specific examples of the polyphenols having three or more hydroxyl groups include trisphenol PA, phenol novolak and cresol novolak. Specific examples of the adducts of a polyphenol having three or more hydroxyl groups with an alkylene oxide include adducts in which an alkylene oxide such as ethylene oxide, propylene oxide and butylene oxide is adducted to the polyphenols mentioned above having three or more hydroxyl groups.

The mixing ratio (DIO:TO) by weight of the diol (DIO) to the polyol (TO) having three or more hydroxyl groups in the mixture thereof is preferably (100:0.01 to 10), and more preferably (100:0.01 to 1).

There is no specific limit to the polycarboxylic acid (PC) and it is possible to suitably select any polycarboxylic acid to purpose. For example, dicarboxylic acids (DIC), polycarboxylic acids (TC) having three or more carboxyl groups, and a mixture in which a polycarboxylic acid (TC) having three or more carboxyl groups is mixed with a dicarboxylic acid (DIC) can be mentioned. These can be used alone or in combination. Among these, a simple dicarboxylic acid (DIC) or a mixture in which a polycarboxylic acid (TC) having three or more carboxyl groups is mixed with a dicarboxylic acid (DIC) is preferred.

Specific examples of the dicarboxylic acids (DIC) mentioned above include alkylene dicarboxylic acids, alkenylene dicarboxylic acids, and aromatic dicarboxylic acids.

Specific examples of the alkylene dicarboxylic acids mentioned above include succinic acid, adipic acid and sebacic acid. The alkenylene dicarboxylic acids mentioned above preferably have 4 to 20 carbon atoms and specific examples thereof include maleic acid and fumaric acid. The aromatic dicarboxylic acids mentioned above preferably have 4 to 20 carbon atoms and specific examples thereof include phthalic acid, isophthalic acid, terephthalic acid and naphthalene dicarboxylic acids. Among these, alkenylene dicarboxylic acids mentioned above having 4 to 20 carbon atoms and aromatic dicarboxylic acids having 8 to 20 carbon atoms are preferred.

Suitably preferred polycarboxylic acids (TC) having three or more carboxyl groups have three to eight carboxyl groups or more carboxyl groups. An example thereof is an aromatic polycarboxylic acid. The aromatic polycarboxylic acids mentioned above preferably have 9 to 20 carbon atoms and specific examples thereof include trimellitic acid and pyromellitic acid.

Acid anhydrides or lower alkyl esters of any one selected from the dicarboxylic acids (DIC) mentioned above, the polycarboxylic acids (TC) mentioned above having three or more carboxyl groups, and the mixture mentioned above in which a polycarboxylic acid (TC) having three or more carboxyl groups is mixed with a dicarboxylic acid (DIC) can be used as the polycarboxylic acids (PC) mentioned above. Specific examples of the lower alkyl esters mentioned above include methyl esters, ethyl esters and isopropyl esters.

There is no specific limit to the mixing ratio (DIC:TC) by weight of the dicarboxylic acid (DIO) to the polycarboxylic acid (TC) having three or more carboxyl groups in the mixture thereof and the mixing ratio can be determined to purpose and is preferably (100:0.01 to 10) and more preferably (100:0.01 to 1).

There is no specific limit to the mixing ratio (PO/PC) of the polyol (PO) to polycarboxylic acid (PC) when the polyol (PO) to polycarboxylic acid (PC) are subject to polycondensation. The equivalence ratio ([OH]/[COOH]) of hydroxyl group [OH] in the polyol (PO) to carboxyl group [COOH] in the polycarboxylic acid (PC) is preferably from 1 to 2, more preferably from 1 to 1.5 and particularly preferably from 1.02 to 1.3.

There is no specific limit to the content of the polyol (PO) in the polyester prepolymer (A) having an isocyanate group. It is possible to add any amount thereof to purpose. For example, the addition amount thereof is preferably from 0.5 to 40 weight %, more preferably from 1 to 30 weight % and particularly preferably from 2 to 20 weight %.

If the addition amount is smaller than 0.5 weight %, the anti-hot offset property deteriorates and it may be difficult to achieve the low temperature fixability and heat-resistant preservability at the same time. If the addition amount is greater than 40 weight %, low temperature fixability may be decline.

There is no specific limit to the polyisocyanate (PIC) mentioned above. It is possible to select any polyisocyanate (PIC) to purpose. Specific examples thereof include aliphatic polyisocyanates, alicyclicpolyisocyanates, aromatic diisosycantes, aromatic aliphatic diisocyanates, isocyanurates, and blocked polyisocyanates in which the polyisocyanates mentioned above are blocked with phenol derivatives thereof, oximes or caprolactams.

Specific examples of the aliphatic polyisocyanates include tetramethylene diisocyanate, hexamethylene diisocyanate, 2,6-diisocyanate methylcaproate, octamethylene diisocyanate, decamethylene diisocyanate, dodeca methylene diisocyanate, tetradeca methylene diisocyanate, trimethylhexane diisocyanate, and tetramethylhexane diisocyanate.

Specific examples of the alicyclic polyisocyanates include isophorone diisocyanate and cyclohexylmethane diisocyanate. Specific examples of the aromatic diisocyanates include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate.

Specific examples of the aromatic aliphatic diisocyanates include $\alpha,\alpha\alpha',\alpha'$-tetramethyl xylylene diisocyanate.

Specific examples of the isocyanurates include tris-isocyanato alkyl isocyanurate, triisocyanato cycloalkyl-isocyanurate.

These compounds can be used alone or in combination.

As to the mixing ratio of when the polyisocyanate (PIC) reacts with the polyester having an active hydrogen group (e.g., a polyester resin having a hydroxyl group), suitable mixing equivalence ratio ([NCO]/[OH]) of isocyanate group [NCO] in the polyisocyanate (PIC) to hydroxyl group in the polyester having a hydroxyl group is preferably from 1 to 5, more preferably from 1.2 to 4 and particularly preferably from 1.5 to 3. When the equivalent ratio ([NCO]/[OH]) is too large, the low temperature fixability may deteriorate. When the equivalent ratio is too small, the anti-hot offset may deteriorate.

There is no specific limit to the content of the polyisocyanate (PIC) in the polyester prepolymer (A) having an isocyanate group. It is possible to determine the content according to the target feature. For example, the content is preferably from 0.5 to 40 weight %, more preferably from 1 to 30 weight % and further preferably from 2 to 20 weight %.

When the content of the polyisocyanate (PIC) in the polyester prepolymer (A) having an isocyanate group is too small, the anti-hot offset property may deteriorate, which leads to difficulty in having a good combination of heat-resistant preservability and low temperature fixability of toner. When the content thereof is too large, the low temperature fixability tends to deteriorate.

The average number of isocyanate groups included in one polyester prepolymer (A) is preferably not less than 1, more preferably from 1.2 to 1.5 and further preferably from 1.5 to 4.

When the average number of isocyanate groups is too small, the molecular weight of the polyester resin (RMPE), which is modified by the urea linkage producing group, may decrease, resulting in deterioration of anti-hot offset. The weight average molecular-weight (Mw) of the polymer reactive with the compound having an active hydrogen group is preferably from 3,000 to 40,000 and more preferably from 4,000 to 30,000 by molecular weight distribution by gel permeation chromatography (GPC) for portions soluble in tetrahydrofuran (THF). When the weight average molecular weight (Mw) is too small, the heat-resistant preservability may deteriorate. When the weight average molecular weight (Mw) is too large, the low temperature fixability may deteriorate.

For example, the molecular weight distribution based on gel permeation chromatography (GPC) can be measured as follows: Stabilize a column in a heat chamber at 40° C.; Flow tetrahydrofuran (THF) at this temperature at 1 ml/min as a column solvent; Fill 50 to 200 μl of a tetrahydrofuran sample solution of a resin which is prepared to have a sample density of 0.05 to 0.6 weight % for measurement. The molecular weight of the sample is calculated by comparing the molecular weight distribution of the sample with logarithm values and count values of the analytical curves obtained from several kinds of single dispersion polystyrene standard sample. Specific examples of the standard polystyrene samples for the analytical curves include polystyrenes having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$, manufactured by Pressure Chemical Co., or Tosoh Corporation. It is preferred to use at least about ten standard polystyrene samples. Refractive index (R1) detectors can be used as the detector.

---The Aqueous Medium---

There is no specific limit to the aqueous medium mentioned above. Any known aqueous media can be suitably selected. For example, water, solvents mixable with water, mixtures thereof can be used. Among these, water is particularly preferred.

There is no specific limit to the solvent mixable with water as long as the solvent can be mixed with water. Specific examples of such a solvent mixable with water include alcohols, dimethylformamide, tetrahydrofuran, cellosolves, and lower ketones.

Specific examples of the alcohols mentioned above include methanol, isopropanol and ethylene glycol. Specific examples of the lower ketones mentioned above include acetone and methyl ethyl ketone. These can be used alone or in combination.

Specific examples of the alcohols mentioned above include methanol, isopropanol and ethylene glycol. Specific examples of the lower ketones mentioned above include acetone and methyl ethyl ketone. These can be used alone or in combination.

The aqueous medium mentioned above can be prepared by dispersing resin particulates in the aqueous medium. There is no specific limit to the addition amount of the resin particulates in the aqueous medium. It is possible to suitably determine the addition amount to purpose. For example, the addition amount is preferably from 0.5 to 10 weight %.

Suitable resins for use as the resin particulates include any known resins that can form an aqueous dispersion in an aqueous medium. Any known resin can be suitably selected to purpose. Specific examples of these resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins and polycarbonate resins. These resins can be used alone or in combination. Among these resins, at least one of vinyl resins, polyurethane resins, epoxy resins, and polyester resins is used to form resin particulates because an aqueous dispersion including fine spherical resin particles can be easily prepared.

Specific examples of the vinyl resins include polymers prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth)acrylic acid copolymers.

In addition, it is possible to use a copolymer having a monomer having at least two unsaturated groups as the resin particulates mentioned above.

There is no specific limit to the monomers having at least two unsaturated groups and it is possible to suitably select any such monomer to purpose. Specific examples thereof include a sodium salt of an adduct of sulfuric ester with ethylene oxide methacrylate (ELEMINOL RS-30, manufactured by Sanyo Chemical Industries), divinyl benzene, and 1,6-hexane diol acrylate.

The resin particulates can be obtained through polymerization using a known method suitably selected to purpose. It is preferred to obtain an aqueous dispersion liquid of the resin particulates. Preferred specific example methods of preparing such aqueous dispersion liquid of the resin particulates include:

(1) in the case of the vinyl resin mentioned above, a method in which an aqueous dispersion liquid of the resin particulate is directly prepared from a starting material, i.e., vinyl monomer, by polymerization reaction based on the polymerization method selected from any one of a suspension polymerization method, an emulsification polymerization method, a seed polymerization method and a dispersion polymerization method;

(2) in the case of a polyaddition or polycondensation resin such as polyester resins, polyurethane resins and epoxy resins, a method in which a precursor such as monomer and oligomer or a solvent or solution thereof is dispersed in an aqueous medium under the presence of a desired dispersant and thereafter the resultant is cured by heat or a curing agent to prepare an aqueous dispersion body of a resin particulate;

(3) in the case of a polyaddition or polycondensation resin such as polyester resins, polyurethane resins and epoxy resins, a method in which a desired emulsifier is dissolved in a precursor such as monomer and oligomer or a solvent or solution thereof (liquid is preferred. Heating is possible for liquidization) and thereafter an aqueous medium is added thereto for phase change emulsification;

(4) a method in which a resin already prepared by any polymerization reaction such as addition polymerization, ring scission polymerization, polyaddition, addition condensation and condensation polymerization is pulverized by a mechanical rotation type or jet type fine pulverizer, the resultant is classified to obtain resin particulates, and the resultant is dispersed in an aqueous medium under the presence of a desired dispersant;

(5) a method in which a resin already prepared by any polymerization reaction such as addition polymerization, ring scission polymerization, polyaddition, and condensation polymerization is dissolved in a solvent to obtain a resin solution followed by spraying the resin resolution to obtain resin particulates and the resin particulates are dispersed in an aqueous medium under the presence of a desired dispersant;

(6) a method in which a resin already prepared by any polymerization reaction such as addition polymerization, ring scission polymerization, polyaddition, and condensation polymerization is dissolved in a solvent to obtain a resin particulate solution, a poor solvent is added thereto or resin particulates are precipitated by cooling the resin solution dissolved in the solvent by heating, the solvent is removed to obtain resin particulates and the resin particulates are dispersed in an aqueous medium under the presence of a desired dispersant;

(7) a method in which a resin already prepared by any polymerization reaction such as addition polymerization, ring scission polymerization, polyaddition, addition condensation and condensation polymerization is dissolved in a solvent to obtain a resin solution, the resin solution is dispersed in an aqueous medium under the presence of a desired dispersant and the solvent is removed by heat or reducing pressure; and (8) a method in which a resin already prepared by any polymerization reaction such as addition polymerization, ring scission polymerization, polyaddition, addition condensation and condensation polymerization is dissolved in a solvent to obtain a resin solution, a desired emulsifier is dissolved therein, and an aqueous medium is added to perform phase change emulsification.

---Emulsification and Dispersion---

As for the emulsification and dispersion of a solution or a dispersion liquid of the toner component in the aqueous medium, it is preferred to disperse the solution or the dispersion liquid of the toner component in the aqueous medium while stirring. There is no specific limit to the dispersion methods. It is possible to suitably select any methods to purpose. For example, any known dispersion device can be used. Specific examples thereof include a low speed shearing type dispersion device and a high speed shearing type dispersion device.

In the toner manufacturing methods mentioned above, when the compound having an active hydrogen group and the polymer reactive therewith are subject to elongation reaction or cross linking reaction during the emulsification and dispersion mentioned above, an adhesive base material (the resin mentioned above) is produced.

---Adhesive Base Material---

The adhesive base material contains at least an adhesive polymer showing adhesiveness to a recording medium such as paper, which is prepared by reacting the compound mentioned above having an active hydrogen group and the polymer mentioned above reactive therewith in the aqueous medium mentioned above. The adhesive base material can further contain a binder resin suitably selected from known binder resins.

There is no specific limit to the weight average molecular-weight of the adhesive base material mentioned above and it is possible to determine the weight average molecular weight thereof to purpose. For example, the weight average molecular weight is preferably not less than 3,000, more preferably from 5,000 to 1,000,000 and particularly preferably from 7,000 to 500,000. When the weight average molecular weight is too small, the anti-hot offset property may deteriorate.

There is no specific limit to the glass temperature (Tg) of the adhesive base material and it is possible to determine the glass temperature (Tg) thereof to purpose. The glass temperature (Tg) thereof is preferably from 30 to 70° C., and more preferably from 40 to 65° C. Since elongated polyester resins are co-existent in the toner mentioned above, toner particles has a good preservability even when the glass transition temperature is relatively low in comparison with that of typical polyester based toner particles.

When the glass transition temperature (Tg) is too low, the heat-resistant preservability of toner particles may deteriorate. When the glass transition temperature (Tg) is too high, the low temperature fixability may be insufficient.

The glass transition temperature mentioned above can be measured by the following method in which, for example, TG-DSC system TAS-100 (manufactured by Rigaku Corporation) is used: Put about 10 mg of toner particles in a sample container made of aluminum; Place the sample container on a holder unit; Set the holder unit in an electric furnace; Heat the electric furnace from room temperature to 150° C. at a rising rate of 10° C./min; Leave it at 150° C. for 10 minutes; Cool the sample to room temperature and leave it for 10 minutes; Thereafter, heat the sample to 150° C. at a decreasing rate of 10° C./min; Measure DSC curve by a differential scanning calorimeter (DSC); and, from the obtained DSC curve, calculate the glass transition temperature (Tg) from the intersection point of a tangent of the endothermic curve around the glass transition temperature (Tg) and the base line using the analysis system installed in TG-DSC system TAS-100 system.

There is no specific limit to the adhesive base material and it is possible to select any of them to purpose. Polyester based resins, etc., are especially preferred. There is no specific limit to the polyester based resins mentioned above and it is possible to select any polyester based resin to purpose. Urea modified polyester based resins are particularly preferred.

The urea modified polyester based resins are obtained by reacting the amine (B) as a compound having an active hydrogen group with the polyesterprepolymer (A) having an isocyanate group as a polymer reactive therewith in the aqueous medium mentioned above.

Other than a urea linkage, the urea modified polyester based resins mentioned above may contain a urethane linkage. There is no specific limit to the content mol ratio (urea linkage/urethane linkage) of the urea linkage and the urethane linkage. It is possible to be determined to purpose. The content mol ratio is preferably from 100/0 to 10/90, more preferably from 80/20 to 20/80, and particularly preferably from 60/40 to 30/70.

When the ratio of the urea linkage is too small, the anti-hot offset property may deteriorate.

Preferred specific examples of the urea modified polyester resins include (1) to (10). These are:

(1) a mixture of a polycondensation product of an adduct of bisphenol A with 2 mol of ethylene oxide and isophthalic acid, and a compound prepared by urea-modifying a polyester prepolymer with isophorone diamine, the polyester prepolymer being prepared by reacting a polycondensation product of an adduct of bisphenol A with 2 mol of ethylene oxide and isophthalic acid with isophorone diisocyanate;

(2) a mixture of a polycondensation product of an adduct of bisphenol A with 2 mol of ethylene oxide and terephthalic acid, and a compound prepared by urea-modifying a polyester prepolymer with isophorone diamine, the polyester prepolymer being prepared by reacting a polycondensation product of an adduct of bisphenol A with 2 mol of ethylene oxide and isophthalic acid with isophorone diisocyanate;

(3) a mixture of a polycondensation product of an adduct of bisphenol A with 2 mol of ethylene oxide, an adduct of bisphenol A with 2 mol of propylene oxide and terephthalic acid, and a compound prepared by urea-modifying a polyester prepolymer with isophorone diamine, the polyester prepolymer being prepared by reacting a polycondensation product of an adduct of bisphenol A with 2 mol of ethylene oxide, an adduct of bisphenol A with 2 mol of propylene oxide and terephthalic acid with isophorone diisocyanate;

(4) a mixture of a polycondensation product of an adduct of bisphenol A with 2 mol of propylene oxide and terephthalic acid, and a compound prepared by urea-modifying a polyester prepolymer with isophorone diamine, the polyester prepolymer being prepared by reacting a polycondensation product of an adduct of bisphenol A with 2 mol of ethylene oxide, an adduct of bisphenol A with 2 mol of propylene oxide and terephthalic acid with isophorone diisocyanate;

(5) a mixture of a polycondensation product of an adduct of bisphenol A with 2 mol of ethylene oxide and terephthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide and terephthalic acid with isophorone diisocyanate;

(6) a mixture of a polycondensation product of an adduct of bisphenol A with 2 mol of ethylene oxide, an adduct of bisphenol A with 2 mol of propylene oxide and terephthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide, an adduct of bisphenol A with 2 mol of propylene oxide and terephthalic acid with isophorone diisocyanate;

(7) a mixture of a polycondensation product of an adduct of bisphenol A with 2 mol of ethylene oxide and terephthalic acid, and a compound prepared by urea-modifying a polyester prepolymer with ethylene diamine, the polyester prepolymer being prepared by reacting a polycondensation product of an adduct of bisphenol A with 2 mol of ethylene oxide and terephthalic acid with isophorone diisocyanate;

(8) a mixture of a polycondensation product of an adduct of bisphenol A with 2 mol of ethylene oxide and isophthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide and isophthalic acid with diphenyl methane diisocyanate;

(9) a mixture of a polycondensation product of an adduct of bisphenol A with 2 mol of ethylene oxide, an adduct of bisphenol A with 2 mol of propylene oxide and terephthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide, an adduct of bisphenol A with 2 mol of propylene oxide, terephthalic acid and dodecenyl succinic anhydride with diphenyl methane diisocyanate;

(10) a mixture of a polycondensation product of an adduct of bisphenol A with 2 mol of ethylene oxide and isophthalic acid, and a compound prepared by urea-modifying a polyester prepolymer with hexamethylene diamine, the polyester prepolymer being prepared by reacting a polycondensation product of an adduct of bisphenol A with 2 mol of ethylene oxide and isophthalic acid with toluene diisocyanate.

---Binder Resin---

There is no specific limit to the binder resin mentioned above and it is possible to suitably select any binder resin to purpose. For example, polyester resins can be selected. Especially, non-modified polyester resins (unmodified polyester resins) are preferred.

The toner containing the non-modified polyester resins has a good low temperature fixability and gloss property.

As non-modified polyester resins, similar to the case of the polyester resins having urea linkage producing group, polycondensation products of polyols (PO) and polycarboxylic acids (PC) are mentioned. Part of the non-modified polyester resin is preferably dissolved to the polyester resin (RMPE) having a urea linkage producing group, meaning that both preferably have similar structures compatible to each other, in terms of low temperature fixability and anti-hot offset property.

The weight average molecular weight (Mw) of the non-modified polyester resin mentioned above is preferably from 1,000 to 30,000 and more preferably from 1,500 to 15,000 by molecular-weight distribution by gel permeation chromatography (GPC) for portions soluble to tetrahydrofuran (THF). When the weight average molecular weight (Mw) is too small, the heat-resistant preservability may deteriorate. Therefore, as mentioned above, the content of the component having a weight average molecular weight (Mw) is desired to be 8 to 28% by weight. When the weight average molecular weight (Mw) is too large, the low temperature fixability may deteriorate.

The glass transition temperature of the non-modified polyester resin is preferably from 35 to 70° C. When the glass temperature mentioned above is too low, the heat-resistant preservability of toner may deteriorate. When the glass temperature is too high, the low temperature fixability thereof may deteriorate.

The hydroxyl value of the non-modified polyester resin is preferably not less than 5 mgKOH/g, more preferably from 10 to 120 mgKOH/g and further preferably from 20 to 80 mgKOH/g. When the hydroxyl value is too small, the heat-resistance property and low temperature fixability may not be achieved at the same time.

The acid value of the non-modified polyester resin is normally from 1.0 to 30.0 mgKOH/g, and preferably from 5.0 to 20.0 mgKOH/g. In general, when the toner mentioned above has an acid value, the toner tends to be negatively charged.

When the toner mentioned above contains the non-modified polyester resin mentioned above, the mixture weight ratio (RMPE/PE) of the polyester based resin having a urea linkage producing group mentioned above (RMPE) and the non-modified polyester resin (PE) is preferably from 5/95 to 25/75 and more preferably from 10/90 to 25/75.

When the mixture weight ratio of the non-modified polyester resin (PE) is too large, the anti-hot offset property may deteriorate. When the mixture weight ratio of the non-modified polyester resin (PE) is too small, the low temperature fixability and gloss property of an image may deteriorate.

The content of the non-modified polyester resin in the binder resin mentioned above is, for example, preferably from 50 to 100 weight % and more preferably from 55 to 95 weight %. When the content is too small, the low temperature fixability and the strength and gloss property of a fixed image may deteriorate.

The adhesive base material, e.g., the urea modified polyester resin, can be prepared by, for example, the following methods:

(1) Emulsify or disperse in the aqueous medium mentioned above a solution or a dispersion liquid of the toner component mentioned above containing a polymer (e.g., the polyester prepolymer (A) mentioned above having an isocyanate group) reactive with the compound mentioned above having an active hydrogen group together with the compound mentioned above having an active hydrogen group (e.g., the amines (B)) to form the oil droplets mentioned above and perform elongation reaction and cross linking reaction of the polymer and the compound;

(2) Emulsify or disperse a solution or a dispersion liquid of the toner component mentioned above in the aqueous medium to which the compound mentioned above having an active hydrogen group is added beforehand to form the oil droplets mentioned above and perform elongation reaction and cross linking reaction of the polymer and the compound; and (3) Admix a solution or a dispersion liquid of the toner component mentioned above in the aqueous medium and then add the compound mentioned above having an active hydrogen group thereto to form the oil droplets mentioned above and perform elongation reaction and cross linking reaction of the polymer and the compound.

In the case of (3) mentioned above, modified polyester resins are preferentially produced on the surface of the toner prepared so that the concentration gradient can be laid in the toner particle.

There is no specific limit to the reaction conditions for producing the adhesive base material by the emulsification and the dispersion mentioned above. It is possible to suitably select conditions based on the combination of the compound mentioned above having an active hydrogen group and the polymer reactive therewith. The reaction time is preferably from 10 minutes to 40 hours and more preferably from 2 hours to 24 hours.

As a method of stably forming the dispersion body mentioned above containing a polymer (e.g., the polyester prepolymer (A) having an isocyanate group) reactive with the compound mentioned above having an active hydrogen group in the aqueous medium mentioned above, for example, there is a method in which a solution or a dispersion liquid of the toner component prepared by dissolving or dispersing in the organic solvent mentioned above the toner component mentioned above such as a polymer (e.g., the polyester prepolymer (A) having an isocyanate group) reactive with the compound mentioned above having an active hydrogen group, the colorant mentioned above, the wax mentioned above, the charge control agent mentioned above, the non-modified polyester resin mentioned above is added to the aqueous medium mentioned above to perform dispersion by shearing force.

The content of the aqueous medium mentioned above in the emulsification and dispersion mentioned above is preferably from 50 to 2,000 parts by weight and more preferably from 100 to 1,000 pasts by weight based on 100 parts by weight of the toner component.

When the content mentioned above is too small, the dispersion state of the toner component mentioned above is poor so that toner particles having a desired particle diameter are not obtained. When the content is too large, the production cost may increase.

In the emulsification and the dispersion mentioned above, a dispersant can be preferably used in order to obtain a sharp particle size distribution with a desired particle form.

There is no specific limit to the dispersant and it is possible to suitably select any dispersant to purpose. Specific examples thereof include surface active agents, inorganic compound dispersants hardly soluble to water, and polymeric protective colloids.

These can be used alone or in combination. Among these, surface active agents are preferred.

As the surface active agents, there are anionic surface active agents, cationic surface active agents, nonionic surface active agents, and ampholytic surface active agents.

Specific examples of anionic surface active agents include alkylbenzene sulfonic acid salts, α-olefin sulfonic acid salts, and phosphoric acid esters. Among these, surface active agents having a fluoroalkyl group are preferred. Specific examples of the anionic surface active agents having a fluoroalkyl group include fluoroalkyl carboxylic acids having from 2 to 10 carbon atoms and their metal salts, disodium perfluorooctane sulfonylglutamate, sodium 3-{omega-fluoroalkyl (having 6 to 11 carbon atoms) oxy}-1-alkyl (having 3 to 4 carbon atoms) sulfonate, sodium 3-{omega-fluoroalkanoyl (having 6 to 8 carbon atoms)-N-ethylamino}-1-propanesulfonate, fluoroalkyl (having 11 to 20 carbon atoms) carboxylic acids and their metal salts, perfluoroalkylcarboxylic acids and their metal salts, perfluoroalkyl (having 4 to 12 carbon atoms) sulfonate and their metal salts, perfluorooctanesulfonic acid diethanol amides, N-propyl-N-(2-hydroxyethyl) perfluorooctanesulfone amide, perfluoroalkyl(having 6 to 10 carbon atoms) sulfoneamidepropyltrimethylammonium salts, salts of perfluoroalkyl(having 6 to 10 carbon atoms)-N-ethylsulfonyl glycin, and monoperfluoroalkyl (having 6 to 16 carbon atoms) ethylphosphates.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents include amine salt type surface active agents and quaternary ammonium salt type anionic surface active agents. Specific examples of the amine salt type surface active agents include alkyl amine salts, amino alcohol fatty acid derivatives, polyamine fatty acid derivatives, and imidazoline. Specific examples of the quaternary ammonium salt type cationic surface active agents include alkyl trimethyl ammonium salts, dialkyl dimethyl ammonium salts, alkyl dimethyl benzyl ammonium salts, pyridinium salts, alkyl isoquinolinium salts, and benzetonium chloride. Among these, primary, secondary and tertiary aliphatic amines having a fluoroalkyl group, aliphatic quaternary ammonium salts such as perfluoroalkyl (having 6 to 10 carbon atoms) sulfoneamidepropyltrimethylammonium salts, benzalkonium salts, benzetonium chloride, pyridinium salts and imidazolinium salts. Specific examples of the marketed products of the cationic surface active agents include SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

Specific examples of the nonionic surface active agents include fatty acid amide derivatives, and polyalcohol derivatives. Specific examples of amopholytic surface active agents include alanine, dodecyldi(amino ethyl)glycine, di(octyl amonoethyl)glycine, and N-alkyl-N,N-dimethyl ammonium betaine.

An inorganic compound such as calcium phosphate, calcium carbonate, titanium oxide, colloidal silica, and hydroxyapatite can also be used as the inorganic compound dispersant hardly soluble to water.

Specific examples of the polymeric protective colloids include acids, (meth)acrylic monomer having a hydroxyl group, vinyl alcohol or ethers thereof, esters of vinyl alcohol and a compound having a carboxylic group, amide compounds or methylol compounds thereof, chlorides, homopolymers or copolymers having a nitrogen atom or a heterocyclic ring thereof, polyoxyethylene based compounds and celluloses.

Specific examples of the acids mentioned above include acrylic acid, methacrylic acid, α-cyanoacrylic acid, α-cyanomethacrylic acid, itaconic acid, crotonic acid, fumaric acid, maleic acid and maleic anhydride. Specific examples of the (meth)acrylic monomer mentioned above having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide. Specific examples of vinyl alcohols mentioned above or its ethers include vinyl methyl ether, vinyl ethyl ether and vinyl propyl ether. Specific examples of the esters mentioned above of vinyl alcohol and a compound having a carboxylic group include vinyl acetate, vinyl propionate and vinyl butyrate. Specific examples of the amide compounds mentioned above or their methylol compounds include acrylamide, methacrylamide and diacetone acrylamide acid and their methylol compounds. Specific examples of the chlorides mentioned above include acrylic acid chloride and methacrylic acid chloride. Specific examples of homopolymers or copolymers mentioned above having a nitrogen atom or a heterocyclic ring thereof include vinyl pyridine, vinyl pyrrolidone, vinyl imidazole and ethylene imine. Specific examples of the polyoxyethylene mentioned above include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Specific examples of the celluloses mentioned above include methyl cellulose, hydroxyethyl cellulose and hydroxypropyl cellulose.

It is possible to use a dispersion stabilizer in preparation of the dispersion liquid mentioned above. Specific examples of the dispersion stabilizers include compounds such as calcium phosphate soluble in an alkali and an acid.

When the dispersion stabilizer is used, it is possible to remove calcium phosphate from particulates by a method of washing with water or a method of decomposing with enzyme after dissolving calcium phosphate with an acid such as hydrochloric acid.

When the dispersion liquid mentioned above is prepared, it is possible to use a catalyst for elongation and/or cross linking reaction. Specific examples thereof include dibutyltin laurate and dioctyltin laurate.

The organic solvent mentioned above is removed from the emulsified slurry obtained from the emulsification and/or dispersion.

The organic solvent can be removed by a method such as (1) a method in which the organic solvent mentioned above in the oil droplets mentioned above is completely evaporated by raising the temperature of the entire reaction system, and (2) a method in which an emulsified dispersion body is sprayed in dry atmosphere to form toner particulates by completely removing the non-water soluble organic solvent in the oil droplets to form toner particulates while evaporating and removing the aqueous dispersant together.

Toner particles are formed when the organic solvent mentioned above is removed. The toner particles can be washed, dried and so on and thereafter classified if desired. Such classification can be performed in the liquid by removing particulate portions using a cyclone, a decanter, or a centrifugal separator, or can be performed for powder toner particles obtained after drying.

The thus prepared toner powder particles can be mixed with other particles such as the colorants mentioned above, the waxes mentioned above, and the charge controlling agents mentioned above. Such fine particles can be fixed on and in toner particles by applying a mechanical impact thereto. Thus the particles such as the waxes can be prevented from being detached from the surface of the toner particles.

Specific examples of such mechanical impact application methods include a method in which a mechanical impact is applied by a high speed rotation blade and a method in which a mixture is put into a jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara-Machine Co., Ltd.), KRYPTRONSYSTEM (manufactured by Kawasaki Heavy Industries, Ltd.), automatic mortars, etc.

Below is a description about toner particles prepared by the suspension polymerization method.

As mentioned above, toner particles prepared by the suspension polymerization method can be obtained by preparing emulsion and/or dispersion liquid (suspension liquid) and by emulsifying and/or dispersing a solution and/or dispersion liquid (suspension liquid) of toner component in an aqueous medium followed by granulating toner particles. Solution and/or dispersion liquid of toner component.

---The Solution and/or the Dispersion Liquid of the Toner Component---

In the suspension polymerization method mentioned above, the solution and/or the dispersion liquid of the toner component is obtained as a polymeric monomer and an oil soluble polymerization initiator. It is preferable to dissolve the plasticizer in a polymeric monomer and an oil soluble polymerization initiator and if necessary, other agents such as colorant, wax, and a charge control agent are also dissolved. In addition, if desired, it is possible to add an organic solvent, a polymer, a dispersant, etc., to reduce the viscosity of the polymer produced in the polymerization reaction described later.

---Polymeric Monomer---

Functional groups can be introduced onto the surface of a toner particle by using part of acids such as acrylic acid, methacrylic acid, α-cyano acrylic acid, α-cyano methacrylic acid, itaconic acid, fumaric acid, maleic acid and maleic anhydride, and acrylates an methacrylates having an amino group such as acryl amide, methacyl amide, diacetone acryl amide, their methylol compounds, vinyl pyridine, vinyl pyrolidone, vinyl imidazole, ethylene imine, and dimethyl amino ethyl methacrylate. In addition, when a dispersant having an acid group and a basic group is suitably selected, functional groups can be also introduced by absorbing the dispersant to remain on the surface of a toner particle.

Specific examples of the polymeric monomers include styrene based monomers such as styrene, o-methyl styrene, m-methylstyrene, p-methyl styrene, p-methoxy styrene and p-ethyl styrene, acrylic acid esters such as methyl acrylate, ethyl acrylate, n-butyl acrylate, isobutyl acrylate, n-propyl acrylate, n-octyl acrylate, dodecyl acrylate, 2-ethyl hexyl acrylate, stearyl acrylate, 2-chloroethyl acrylate and phenyl acrylate, methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexylmethacrylate, stearylmethacrylate, phenyl methacrylate, dimethyl amino ethyl methacrylate, and diethyl amino ethyl methacrylate, and other acrylonitriles, methacrylonitriles and acrylic amides.

In addition, resins can be added to the polymeric monomers mentioned above. For example, since the polymeric monomers mentioned above are water soluble, the polymeric monomers are dissolved in an aqueous suspension liquid, meaning that emulsification polymerization is not performed. Therefore, when a polymeric monomer having a hydrophilic functional group such as an amino group, a carboxylic group, a hydroxyl group, a sulfone group, a glycidyl group and a nitrile group is desired to be introduced in toner, resins can be used which take a form of copolymers such as random copolymers, blocked copolymers and graft copolymers formed of such a polymeric monomer having a hydrophilic functional group and vinyl compounds such as styrene and ethylene, polycondensation such as polyesters and poly amides, and polyaddition polymers such as polyethers and polyimines.

The alcohol components and the acid components forming the polyester resin mentioned above are as follows:

Specific examples of the alcohol components include ethylene glycol, propylene glycol, 1,3-butane diol, 1,4-butan diol, 2,3-butane diol, diethylene glycol, triethylene glycol, 1,5-pentane diol, 1.6-hexane diol, neopentyl glycol, 2-ethyl-1,3-hexane diol, cyclohexane dimenthol, butene diol, octene diol, cyclohexene dimethanol, and hydrogenated bisphenol A. In addition, polyols such as glycerine, pentaerythritol, sorbid, sorbitan, oxyalkylene ether of novolac type phenol resin can be used.

Specific examples of the acid components include carboxylic acids having two carboxyl groups and their anhydrides such as benzene dicarboxylic acid such as phthalic acid, terephthalic acid, and isophthalic acid and phthalic anhydride, alkyl dicarboxylic acids such as succinic acid, adipic acid, sebacic acid, and azelaic acid and their anhydrides, succinic acids substituted with an alkyl group or alkenyl group having 6 to 18 carbon atoms and their anhydrides, and unsaturated dicarboxylic acids such as fumaric acid, maleic acid, citraconic acid, and itaconic acid and their anhydrides. In addition, poly carboxylic acids such as trimellitic acid, pyromellitic acid, 1,2,3,4-betane tetra carboxylic acid, benzophenone tetracarboxylic acid and their anhydrides can be also used.

With regard to the content of the alcohol components mentioned above and the acid components mentioned above, the content of the alcohol component mentioned above is preferably from 45 to 55 mol % and the acid component mentioned above is preferably from 55 to 45 mol %.

The polyester resins mentioned above can be used in combination as long as the combination does not have an adverse effect on the physicality of the toner particle obtained. In addition, it is possible to control the physicality, for example, modification by a compound having silicon or a fluoroalkyl group.

When a polymer having such a polar functional group is used, the average molecular weight of the polymer is preferably not less than 5,000.

Further, in addition to the polymeric monomers mentioned above, the following resins can be used. These resins are: styrene and its substituted monopolymers such as poly styrene and polyvinyl toluene; styrene based copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate, styrene-dimethyl aminoethyl acrylate copolymers, styrene-methyl methacrylate copolymers, styrene-ethyl methacrylate copolymers, styrene-butyl methacrylate copolymers, styrene-dimethyl amino ethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene-maleic acid ester copolymers; polymethyl methacrylate, polybutyl methacrylate, polyvinyl acetate resin, polyethylene, polypropylene, polyvinyl butyral, silicone resins, polyester resins, polyamide resins, epoxy resins, polyacrylic resins, rosin, modified rosins, terpene resins, phenol resins, aliphatic or alicyclic hydrocarbon resins and aromatic petroleum resins. These can be used alone or in combination.

The addition amount of these resins is preferably from 1 to 20 parts by weight based on 100 parts by weight of the polymeric monomer mentioned above. When the addition amount is too small, the addition effect of adjusting the physicality of toner particles may not be exercised. When the addition amount is too large, designing the physicality of toner particles may be difficult.

In addition, it is possible to dissolve and polymerize a polymer having a different molecular weight range from that of toner obtained by polymerizing the polymeric monomer mentioned above in the polymeric monomer mentioned above.

---Oil Soluble Polymerization Initiator---

When the oil soluble polymerization initiator having a half period of 0.5 to 30 hours during polymerization reaction is added in an amount of 0.5 to 20 parts by weight based on 100 parts by weight of the polymeric monomer, a polymer having a peak between a molecular weight of 10,000 and 100,000 can be obtained. Thereby, a preferred strength and desired dissolution characteristics are imparted to the toner obtained.

There is no specific limit to the oil soluble polymerization initiators and it is possible to suitably select any oil soluble polymerization initiator to purpose. Specific examples thereof include azo-based or diazo-based polymerization initiators such as 2,2-azobis-isobutyronitrile, 1,1'-azobis-(cyclohexane-a-carbonitrile), 2,2' azobis-4-methoxy-2,4-dimethyl valeronitrile, and azobis-isobutyronitrile; and hyperoxidation polymerization initiators such as benzoil peroxide, methylethyl ketone peroxide, diisopropyl peroxy carbonate, cumene hydroperoxide, 2,4-dichlorobenzoyl peroxide, lauroyl peroxide, and t-butyl peroxy 2-ethyl hexanoate.

It is preferred for the aqueous medium mentioned above to contain a dispersion stabilizer. Specific examples thereof include a known surface active agent, an organic dispersant, and an inorganic dispersant. Among these, inorganic dispersants are preferred in that the inorganic dispersants hardly produce harmful super fine particles, and can obtain dispersion stability according to steric hindrance. Further, such inorganic dispersants are stable to changes in reaction temperature and are easy to wash. Therefore, there is no adverse effect on toner.

There is no specific limit to the other components mentioned above. Therefore, such other components can be selected based on the desired purpose. Specific examples thereof include colorants, waxes, charge control agents and cross-linking agent.

There is no specific limit to colorants. Known dyes and pigments can be selected to purpose such as carbon black, yellow dyes, magenta dyes, cyan dyes.

Specific examples of such yellow dyes include condensation azo compounds, isoindolinone compounds, anthraquinone compounds, azo metal complexes, methylene compounds, and allylamide compounds. Preferable examples of such yellow dyes include C.I. pigment yellow, 12, 13, 14, 15, 17, 62, 74, 83, 93, 94, 95, 109, 110, 111, 128, 129, 147, 168 and 180.

Specific examples of such magenta dyes include condensation azo compounds, diketopyrolo-pyrole compounds, anthraquinone compounds, quinacridone compounds, basic dye lake compounds, naphthol compounds, benzimidazolone compounds, thioindigo compounds, and perylene compounds. Preferable examples of such magenta dyes include C.I. pigment red 2, 3, 5, 6, 7, 23, 48:2, 48:3, 48:4, 57:1, 81:1, 122, 146, 166, 169, 177, 184, 185, 202, 206, 220, 221 and 254.

Specific cyan dyes include copper phthalocyanine compounds and their derivatives, anthraquinone compounds, basic dye lake compounds. Preferable examples of such cyan dyes include C.I. pigment blue 1, 7, 15, 15:1, 15:2, 15:3, 15:4, 60, 62 and 66.

The colorants can be used alone or in combination and can be used in solid solution state. The colorant can be selected to purpose such as hue angle, color saturation, lightness, anti-weatherability, transparent sheet transparency, and dispersability in toner.

There is no specific limit to the content of such a colorant. The content thereof can be suitably selected to purpose but is preferably from 1 to 20 weight % based on the weight of the resin.

Specific examples of such waxes include petroleum waxes such as paraffin, microcrystalline wax and petrolatum and its derivative; montan wax and its derivative; hydrocarbon waxes such as Fisher-Tropsch wax and its derivative; polyolefin waxes such as polyethylene wax and its derivative; natural waxes such as carnauba wax, candellia wax and its derivative. The derivative includes oxide, blocked copolymers with vinyl monomer and graft copolymers. Also, aliphatic acid such as higher aliphatic alcohol, stearic acid, palmitic acid, acid amide waxes, ester waxes, ketone, aromatic hydrogenated castor oil and its derivative, plant waxes and animal waxes can be used.

There is no specific limit to the charge control agent mentioned above. Any known charge control agents can be suitably selected to purpose. If toner particles are produced by polymerization reaction, it is preferable to select a charge control agent which does not suffocate the polymerization reaction and is hardly compatible with aqueous medium. Specific examples of the charge control agents for negative polarity include aromatic carboxylic acid-base metallic complex such as salicylic acid, alkyl salicylic acid, dialkyl salicylic acid, naphthoic acid, metal salt or metallic complex of azo dye or azo pigment, high polymer having sulfo acid group or carboxylic acid group in the side chain, boron compound, urea compound, silicon compound, calixarene, etc. Specific examples of the charge control agents for positive polarity include quaternary ammonium salt, high polymer having quaternary ammonium salt group in the side chain, guanidine compound, nigrosine series compound, imidazole compound, etc.

The charge control agent is contained inside toner or added on the surface of toner particles.

The charge control agent is not particularly limited because the content is determined depending on the species of the kind of the resin mentioned above, whether or not an additive is added, and toner manufacturing method (such as dispersion method) used. However, the content of the charge control agent is preferably from 0.1 to 10 parts by weight, and more preferably from 0.1 to 5 parts by weight, per 100 parts by weight of the binder resin contained in the toner when the charge control agent is contained inside toner. The content of the charge control agent is preferably from 0.005 to 1.0 parts by weight, and more preferably from 0.01 to 0.3 parts by weight, per 100 parts by weight of the binder resin contained in the toner when the charge control agent is added on the surface of toner particles.

There is no specific limit to the cross-linking agent mentioned above. Although any known cross-linking agent can be suitably selected to purpose, compounds having two or more polymerizable double bonds is preferable. Specific examples of the compound is: aromatic divinyl compound such as divinylbenzene, divinylnaphthalene; carboxylic acid ester having two double bonds such as ethylene glycol, diacrylate, ethylene glycol dimethacrylate, 1,3-butane diol-dimethacrylate; divinyl compound such as divinylaniline, divinylether, divinylsulfide, divinylsulfone; compound having three or more vinyl group. These can be used alone or in combination.

The content of the cross-linking agent is preferably from 0.01 to 15 parts by weight based on 100 parts by weight of toner.

---Aqueous Medium---

There is no specific limit to the aqueous medium mentioned above and it is possible to suitably select any aqueous medium to purpose.

For example, water can be used.

It is preferred for the aqueous medium mentioned above to contain a dispersion stabilizer.

Specific examples of the inorganic dispersion stabilizer include polyvalent metal salts of phosphoric acid such as calcium phosphate, magnesium phosphate, aluminum phosphate and zinc phosphate, carbonates such as calcium carbonate and magnesium carbonate, inorganic salts such as calcium methasilicate, calcium phosphate and barium sulphate, and inorganic oxides such as calcium hydrate, magnesium hydrate, aluminum hydrate, silica, bentonite and alumina.

The inorganic dispersants can be used as they are. It is also possible to produce inorganic dispersant particles in the aqueous medium mentioned above to obtain finer particles thereof. For example, in the case of calcium phosphate mentioned above, it is possible to produce water insoluble calcium phosphate by mixing an aqueous solution of sodium phosphate with an aqueous solution of calcium chloride while vigorously stirring. Thereby, more uniform and finer dispersion is possible. During the mixing, sodium chloride soluble in water is produced as a by-product. Solution of the polymeric monomer mentioned above to water is limited under the presence of a water soluble salt in the aqueous medium. Thereby, superfine toner particles are hardly produced by emulsification polymerization, which is preferred. However, the by-product is a drawback when the remaining polymeric monomer is removed at the last stage of polymerization reaction. Therefore, it is preferred to exchange the aqueous medium or desalt with a deionization exchange resin. The inorganic dispersant mentioned above can be almost completely removed by dissolving the inorganic dispersant in an alkali or an acid after polymerization.

The inorganic dispersant mentioned above is preferred to be singly used in an amount of 0.2 to 20 parts by weight based on 100 parts by weight of the polymeric monomer mentioned above. When the inorganic solvent mentioned above is used, super fine particles are hardly produced but it is also difficult to obtain toner having a small particle diameter. Therefore, it is preferred to use a surface active agent in an amount of 0.001 to 0.1 parts by weight in combination.

Specific examples of the surface active agents include dodecylbenzene sodium sulfurate, tetradecyl sodium sulfurate, pentadecyl sodiumsulfurate, octyl sodiumsulfurate, sodium oleate, sodium laurate, sodium stearate and kalium stearate.

---Suspension---

The suspension mentioned above is performed by emulsifying and/or dispersing a solution and/or dispersion liquid of the toner component mentioned above in which the toner component is uniformly dissolved and dispersed in the aqueous medium mentioned above. During suspension, when the solution is straightly dispersed to a desired toner particle size level using a high speed dispersion device such as a high speed stirrer and a supersonic dispersion device, toner having a sharp particle size distribution can be obtained.

The oil soluble polymerization initiator mentioned above can be added to the polymeric monomer when other additives are added or immediately before the solution and/or dispersion liquid of the toner component mentioned above is suspended in the aqueous medium mentioned above. In addition, the oil soluble polymerization initiator mentioned above dissolved in the polymeric monomer or a solvent can be also added while granulating toner, immediately after granulating toner, or before starting polymerization reaction.

---Granulation---

The granulation mentioned above is performed by polymerizing the polymeric monomer mentioned above.

The temperature in the polymerization reaction is, for example, not less than 40° C., and typically from 50 to 90° C. When polymerization is performed in the temperature range, the additives such as the wax mentioned above and the wax mentioned above, which are to be existent inside toner particles, can be encapsulated therein through precipitation by phase separation. To consume the remaining polymeric monomer, the reaction temperature is occasionally set to be in the range of from 90 to 150° C. However, as mentioned above, when heated to the melting point of the plasticizer mentioned above, the resin mentioned above and the plasticizer mentioned above are dissolved in each other. Therefore, it is desired to perform reaction at a temperature not higher than the melting point of the plasticizer mentioned above. Specifically, it is preferred to perform the reaction at a temperature not higher than 100° C.

In the granulation mentioned above, it is possible to use a seed polymerization method using the oil soluble polymerization initiator after further adsorbing the polymeric monomer mentioned above to the polymeric particles obtained. It is possible to dissolve and/or disperse a compound having a polarity in the adsorbed polymeric monomer.

After the polymerization reaction mentioned above, it is preferred to stir the resultant with a typical stirrer to prevent the particles from floating and settling therein to maintain the particle state.

Toner particles are obtained from the polymerized particles obtained after polymerization reaction mentioned above using a known method. Redundant active surface active agent mentioned above is removed by filtration and washing. Subsequent to drying, inorganic fine powder is mixed and toner particles are obtained when the inorganic fine powder is attached to the surface of the particle. In addition, it is preferred to classify the particles to remove coarse particles and fine particles.

It is preferable to add inorganic powders having a primary particle diameter of from 4 to 80 nm as a fluidity improvers. Specific examples of the inorganic powder include silica, alumina, titanic oxide, etc.

Specific examples of the silica mentioned above include dry type silica referred to as dry method type or fumed silica which is produced by evaporation phase oxidizing a halogenated silicon as silicic acid fine powder and wet type silica produced from liquid glass, etc. Among these, dry type silica having fewer silanol groups on the surface of or inside the silica fine powder and fewer Na2O, SO3-, etc., remaining after manufacturing. In addition, in the case of the dry type silica, it is possible to obtain complex fine powder of the dry type silica mentioned above and a metal oxide by using, for example, another halogenated metal such as aluminum chloride and titanium chloride with a halogenated silicon and the complex fine powder can be used.

It is preferred that the specific surface area of such an inorganic particulate measured by a BET method is from 20 to 350 m2/g or, more preferably, 25 to 300 m2/g.

The specific surface area mentioned above follows BET method using a specific surface area measuring device (AUTOSORB1, manufactured by Yuasa Ionics Inc.). Nitrogen gas is adsorbed on the surface of a sample and the specific surface area is calculated by using BET multiple point method.

The content of the inorganic particulate in the toner mentioned above is preferably from 0.1 to 3.0% by weight based on the total weight of the toner. If the content is smaller than 0.1% by weight, the fluidity of toner particles may be insufficient. If the content is greater than 3.0% by weight, the fixability of toner particles may be insufficient.

The content of the inorganic particulate in the toner can be measured, for example, by fluorescent X-ray analysis with analytical curve taken from standard specimen.

It is preferable that the inorganic particulate is hydrophobized by a fluidity improver to maintain the features even under high humidity conditions.

Specific examples of the fluidity improver include silicone varnish, various modified silicone varnish, silicone oils, modified silicone oils, silane compound, silane coupling agents, organic silicon compound, organic titanate compound, etc. These can be used alone or in combination.

As a method to hydrophobize, for example, silanol group are removed under a silylation reaction as a first step, then hydrophobic thin layer is formed on the surface of silicone oil as a second step.

The viscosity of the silicone oil mentioned above is, for example, preferably from 10 to 200,000 mm2/s and more preferably from 3,000 to 80,000 mm2/s. When the viscosity mentioned above is too small, the performance of the inorganic fine powder mentioned above tends to be unstable. In that case, image quality may deteriorate upon application of heat or mechanical stress. When the viscosity is too large, uniform hydrophbization treatment may be difficult.

Preferred specific examples of such silicone oils include, for example, dimethyl silicone oil, methyl phenyl silicone oil, α-methyl styrene modified silicone oil, chlorophenyl silicone oil, and fluorine modified silicone oil.

Specific examples of usages of such silicone oils include, for example, a method in which silica treated with a silane coupling compound and a silicone oil are directly mixed with a mixer such as HENSCHEL mixer, a method in which a silicone oil is sprayed on silica, and a method in which, subsequent to dissolution and/or dispersion of a silicone oil in a desired solvent, silica powder is admixed in the solution and/or dispersion liquid and the solvent is removed. Among these methods, the spraying method is preferred in light of relatively less production of an agglomerate of the inorganic fine powder mentioned above.

The content of the silicone oil is, for example, preferably from 1 to 40 parts by weight and more preferably from 3 to 35 parts by weight based on 100 parts by weight of the silica mentioned above.

There is no specific limit to the physicality of toner particles such as form and size and it is possible to determine the physicality thereof to purpose. Preferred physicalities thereof, for example, volume average particle diameter (Dv), ratio (Dv/Dn) of volume average particle diameter (Dv)/number average particle diameter (Dn), penetration, low temperature fixability, and offset non-occurring temperature are as follows.

The volume average particle diameter (Dv) of toner particles is from 3 to 8 μm and more preferably from 4 to 6 μm.

When the volume average particle diameter is too small, toner particles are fused and attached to the surface of carrier particles by stirring in an extended period of time when the two-component developer is used, which leads to deterioration of chargeability of the carrier. In addition, in the case of the one-component developer, filming of toner material on a developing roller or fusion and adhesion of toner material on a member such as a blade to regulate the layer thickness of toner particles easily occur. When the volume average particle diameter is too large, quality images are hard to obtain at a high definition. When toner contained in a developer is replenished, the particle diameter of toner particles may significantly vary.

The ratio (Dv/Dn) of the volume average particle diameter (Dv) to the number average particle diameter (Dn) of a toner is preferably not greater than 1.30 and more preferably from 1.00 to 1.30. When the ratio (Dv/Dn) of the volume average particle diameter (Dv) to the number average particle diameter (Dn) is too small, toner material is fused and attached to the surface of carrier particles by stirring in an extended period of time when the two-component developer is used, which leads to deterioration of chargeability of the carrier and degradation of cleanability. In addition, in the case of the one-component developer, filming of toner material on a developing roller or fusion and adhesion of toner material on a member such as a blade to regulate the layer thickness of toner particles easily occur. When the ratio (Dv/Dn) of the volume average particle diameter (Dv) to the number average particle diameter (Dn) is too large, high quality images are hard to obtain at a high definition. When toner in a developer is replenished, the particle diameter of toner particles may significantly vary.

When the ratio (Dv/Dn) of the volume average particle diameter (Dv) to the number average particle diameter (Dn) is from 1.00 to 1.30, any of preservation stability, low temperature fixability, and anti-hot offset property of toner particles are good. Especially, gloss property of an image is good when the toner is used in a full color image forming apparatus. When toner particles in the two-component developer are replenished over an extended period of time, the particle diameter of toner particles vary relatively less. In addition, good and stable developability is obtained even for stirring in a developing device over an extended period of time. Further, when toner particles of the one-component developer are replenished, the particle diameter of toner particles vary relatively less, and filming of toner material on a developing roller or fusion and adhesion of toner particles on a member such as a blade to regulate the layer thickness of the toner can be improved. Good and stable developability is also obtained even for stirring in a developing device over an extended period of time so that quality images can be obtained.

The volume average particle diameter and the ratio (Dv/Dn) are measured, for example, by means of a particle size analyzer, MultiSizer II, manufactured by Beckmann Coulter Inc.

The penetration mentioned above is preferably not less than 15 mm, and more preferably from 20 to 30 mm when the penetration is measured at the penetration test (JIS K2235-1991). When the penetration mentioned above is too small, the heat-resistant preservability may deteriorate.

The penetration mentioned above can be measured following JIS K2235-1991, incorporated herein by reference. The specific method is as follows: toner particles are filled in a glass contained having 50 ml; toner particles are left in a constant temperature bat at 50° C. for 20 hours; subsequent to cooling down particles to room temperature; and penetration test is performed to measure the penetration thereof. The larger the penetration value is, the more excellent the heat-resistant preservability is.

With regard to the low temperature fixability, in terms of a good combination of decrease in fixing temperature and non-offset, the lower the allowable lowest fixing temperature is, the more preferable the low temperature fixability is. And the higher the non-offset temperature is, the more preferable the low temperature fixability is. The temperature range in which the decrease in the allowable lowest fixing temperature is compatible with non-offset is that the allowable lowest fixing temperature is lower than 150° C. and non-offset temperature is not lower than 200° C.

The allowable lowest fixing temperature is, for example, a temperature at a fixing roll below which the remaining ratio of the density of a fixed image is less than 70% after abrading the fixed image with a pad obtained in a photocopying test in which a transfer paper is set in an image forming apparatus.

The non-offset temperature can be determined by, for example, measuring a temperature at which offset does not occur for solid images of each single color of yellow, magenta, cyan, and black and intermediate colors of red, blue and green on a paper set in an image forming apparatus while controlling to vary the temperature of the fixing belt.

There is no specific limit to the coloring of the present invention and it is possible to suitably select any color to purpose. These can be at least one color toner selected from black toner, cyan toner, magenta toner and yellow toner. Each color toner can be obtained by suitably selecting the kind of the colorants mentioned above.

Toner particles have good characteristics such as fluidity and fixability and have an good combination of low temperature fixability and heat-resistant preservability. Therefore, toner particles can be suitably used in various kinds of fields and more suitably used in electrophotographic image formation. In addition, toner particles can be particularly suitably used in the following developer.

---Developer---

The developer containing toner particles also contains suitably selected other components such as carrier particles. The developer can be a one-component developer or a two-component developer. When such a developer is used in a high speed printer, etc., capable of dealing with recent improvement on information processing speed, the two-component developer is preferred in terms of elongation of life thereof.

When the one-component developer using toner particles mentioned above is replenished, the toner particle diameter varies relatively less and filming of toner particles on a developing roller or fusion and adhesion of toner particles on a member such as a blade to regulate the layer thickness of toner particles does not occur. Therefore, good and stable developability and images can be also obtained even when the developer is used (i.e., stirred) in a developing device over an extended period of time. In addition, in the case of the two-component developer mentioned above, when toner particles are replenished over an extended period of time, the toner particle diameter varies relatively less. In addition, good and stable developability can be also obtained even when the developer is stirred in a developing device over an extended period of time.

There is no specific limit to carrier particles mentioned above and it is possible to suitably select any known carrier to purpose. A carrier particle having a core material and a resin layer coating the core material is preferred.

There is no specific limit to the core material and it is possible to suitably select any known core material. For example, 50 to 90 emu/g of manganese-strontium (Mn-St) based material and manganese-magnesium (Mn—Mg) based material are preferred. In terms of securing image density, a strongly magnetized material such as iron powder (not less than 100 emu/g) and magnetite (75 to 120 emu/g) is preferred. In addition, in terms of advantage in improving quality of images due to weakening the contact pressure of the magnetic brush against the photoconductor, a weakly magnetized material such as a copper-zinc (Co—Zr) (30 to 80 emu/g) based material is preferred. These can be used alone or in combination.

The particle size of the core material mentioned above is preferably from 10 to 150 μm and more preferably from 40 to 100 μm as the volume average particle diameter.

When the average particle diameter (volume average particle diameter (D50)) is too small, the proportion of fine powders increases in distribution of the carrier particles. Thereby, magnetization per particle tends to be reduced, which leads to carrier scattering. When D50 is too large, the specific surface area of toner tends to decrease, which leads to toner scattering. Thereby, reproduction of a full color image having a solid image area may deteriorate especially in the solid image area.

There is no specific limit to the materials for the resin layer mentioned above and it is possible to suitably select any known resin to purpose. Specific examples of such resins include amino-based resins, polyvinyl based resins, polystyrene based resins, halogenated olefin resins, polyester based resins, polycarbonate based resins, polyethylene resins, vinyl polyfluoride resins, vinylidene polyfluoride resins, polytrifluoro ethylene resins, polyhexafluoro propylene resins, copolymers of vinylidene fluoride and an acrylic monomer, copolymers of vinylidene fluoride and vinyl fluoride, fluoroterpolymers such as terpolymers of tetrafluoroethylene, vinylidene fluoride and a non-fluoride monomer, and silicone resins. These can be used alone or in combination.

Specific examples of the amino based resins include urea-formaldehyde resins, melamine resins, benzoguanamine resins, urea resins, polyamide resins, and epoxy resins. In addition, specific examples of polyvinyl resins mentioned above include acrylic resins, polymethylmethacrylate resins, polyacrylonitirile resins, polyvinyl acetate resins, polyvinyl alcohol resins, and polyvinyl butyral resins. Specific examples of the polystyrene resins mentioned above include polystyrene resins, and styrene-acrylic copolymer resins. Specific examples of halogenated olefin resins mentioned above include polyvinyl chloride. Specific examples of the polyester resins mentioned above include polyethylene terephthalate resins and polybutylene terephthalate resins.

The resin layer mentioned above can contain electroconductive powder and so on if desired. Specific examples of such electroconductive powder include metal powder, carbon black, titanium oxide, tin oxide, and zinc oxide. These electroconductive powders preferably have an average particle diameter of not greater than 1 μm. When the average particle diameter is too large, the electric resistance thereof can be hard to control.

The resin layer mentioned above can be formed, for example, as follows: dissolve the silicone resin mentioned above in a solvent to prepare a coating liquid; uniformly apply the coating liquid to the surface of the core material mentioned above by a known applying method; and subsequent to drying, the surface is baked. Specific examples of the applying methods include a dip coating method, a spraying method, and a brushing method.

There is no specific limit to the solvent mentioned above and it is possible to suitably select any solvent to purpose. Specific examples thereof include toluene, xylene, methylethyl ketone, methyl isobutyl ketone, and cellosol butyl acetate.

There is no specific limit to the baking mentioned above. External or internal heating can be used. Specific examples thereof include a method using a fixed type electric furnace, fluidized electric furnace, a rotary type electric furnace or burner furnace, and a method using a microwave.

The content of the carrier mentioned above in the resin layer mentioned above is preferably from 0.01 to 5.0 weight %.

When the content thereof is too small, a uniform resin layer may not be formed on the surface of the core material mentioned above. When the content thereof is too large, the resin layer is too thick so that granulation of carrier particles occurs and uniform carrier particles may not be obtained.

When the developer is the two-component developer mentioned above, the content of carrier particles in the two-component developer has no specific limit and it is possible to suitably determine any content to purpose. The content thereof is preferably from 90 to 98 weight % and more preferably from 93 to 97 weight %.

EXAMPLES AND COMPARATIVE EXAMPLES

Some examples and comparative examples will be described below. However, the present invention is not limited to following examples.

Toner particles A, B, C and D in a two-component developer used in examples and toner particles E, F, G in the two-component developer used in comparative examples were produced by following method.

---Production of Toner Particles A---

<Adhesive Base Material Preparing Process>

Toner was prepared as follows:

---Preparation of Solution and/or Dispersion Liquid of Toner Component---

---Synthesis of Non-Modified Polyester (Polyester Having a Low Molecular Weight)---

A non-modified polyester was synthesized as follows.

(1) The following components were placed in a reaction container having a condenser, a stirrer and a nitrogen introducing tube and reacted for 8 hours at 230° C. under normal pressure.

adduct of bisphenol A with 2 moles of ethylene oxide: 67 parts by weight adduct of bisphenol A with 3 moles of propion oxide: 84 parts by weight terephthalic acid: 274 parts by weight dibutyl tin oxide: 2 parts by weight (2) The reaction was further performed for 5 hours under a reduced pressure of from 10 to 15 mmHg.

The thus obtained non-modified polyester had a number average molecular weight (Mn) of 2,100, a weight average molecular weight (Mw) of 5,600 and a glass transition temperature of 58° C.

---Preparation of Master Batch (MB)---

One thousand (1,000) parts of water, 540 parts of carbon black (Printex 35, manufactured by Degussa AG, having a dibutyl phthalate (DBP) oil absorption of 42 ml/100 mg and a PH of 9.5), and 1200 parts of the non-modified polyester resin mentioned above were mixed using a HENSCHEL mixer (manufactured by Mitsui Mining Company, Limited). This mixture was kneaded for 30 minutes at 150° C. using a two-roll mill followed by rolling and cooling. Then the kneaded mixture was pulverized (manufactured by Hosokawa Micron Co.). A master batch 1 was thus prepared.

---Preparation of Plasticizer Dispersed Liquid---

A plasticizer dispersed liquid was prepared by: mixing 200 parts of polyethylene glycol (manufactured by Matsumoto Yushi Co., having a melting point of 66° C.) as the plasticizer, 400 parts of polyester resin, and 800 parts of ethyl acetate; and dispersing the plasticizer using a bead mill (ULTRAVISCOMILL, manufactured by Aimex Co., Ltd.) under the following conditions: Liquid feeding speed: 1 kg/hr, Disc rotation speed: 6 m/sec, Diameter of zirconia beads: 0.5 mm, Filling factor: 80% by volume, and Time of dispersion treatment: 5 minutes.

---Preparation of Prepolymer---

An intermediate polyester was synthesized as follows.

(1) The following components were placed in a reaction container having a condenser, a stirrer and a nitrogen introducing tube and reacted for 8 hours at 230° C. under normal pressure.

adduct of bisphenol A with 2 moles of ethylene oxide: 682 parts by weight adduct of bisphenol A with 2 moles of propion oxide: 81 parts by weight terephthalic acid: 283 parts by weight anhydride of trimellitic acid: 22 parts by weight dibutyl tin oxide: 2 parts by weight (2) The reaction was further performed for 5 hours under a reduced pressure of from 10 to 15 mmHg.

The thus obtained intermediate polyester had a number average molecular weight (Mn) of 2,100, a weight average molecular weight (Mw) of 9,600, a glass transition temperature of 55° C., an acid value of 0.5 and a hydroxyl value of 49.

Next, a prepolymer (a polymer of the compound mentioned above having an active hydrogen group and the polymer mentioned above reactive therewith) was synthesized as follows:

The following components were placed in a reaction container having a condenser, a stirrer and a nitrogen introducing tube and reacted for 5 hours at 100° C.

Intermediate polyester 411 parts by weight

Isophorone diisocyanate 89 parts by weight

Ethyl acetate 500 parts by weight

The content of isolated isocyanate in the obtained prepolymer was 1.60 weight % and the solid portion density of the prepolymer measured after left at 150° C. for 45 minutes was 50 weight %.

---Preparation of Ketimine (the Compound Mentioned Above Having an Active Hydrogen Group)---

A ketimine compound (the compound mentioned above having an active hydrogen group) was synthesized as follows:

The following components were placed in a reaction container having a stirrer and a thermometer and reacted for 5 hours at 50° C.

Isophorone diamine 30 parts by weight

Methylethyl ketone 70 parts by weight

The thus obtained ketimine compound (the compound mentioned above having an active hydrogen group) had an amine value of 423.

15 parts of the prepolymer mentioned above, 60 parts by weight of the non-modified polyester, 130 parts by weight of ethyl acetate and 100 parts by weight of the plasticizer dispersed liquid were set and dissolved in a beaker while stirring.

Next, solution and/or dispersion liquid of toner component was prepared as follows: 10 parts by weight of carnauba wax (molecular weight of 1,800, acid value of 2.5 and penetration of 1.5 mm at 40° C.), and 10 parts by weight of the master batch mentioned above were added and a material solution was prepared using a bead mill (ULTRAVISCOMILL, manufactured by Aimex Co., Ltd.) under the following conditions:

liquid feeding speed: 1 kg/hr disc rotation speed: 6 m/sec diameter of zirconia beads: 0.5 mm, filling factor: 80% by volume repeat number of dispersion treatment: 3 times.

Thereafter, 2.7 parts by weight of the ketimine compound was added and dissolved therein to prepare a solution or a dispersion of a toner component.

---Preparation of Aqueous Medium Phase---

An aqueous medium phase was prepared by mixing and stirring to uniformly dissolve 306 parts by weight of deionized water, 265 parts by weight of 10 weight % suspension of tricalcium phosphate, and 0.2 parts by weight of sodium dodecyl benzene sulfonate.

---Preparation of Emulsification and/or Dispersion Liquid---

150 parts by weight of the aqueous medium phase mentioned above were set in a container and stirred using a TK HOMOMIXER (manufactured by Tokushu Kika Kogyo Co., Ltd.) at a revolution of 12,000 rpm. 100 parts by weight of the solution and/or dispersion liquid of the toner component mentioned above were added thereto and the resultant was mixed for 10 minutes to prepare an emulsification and/or dispersion liquid (emulsified slurry).

---Removal of Organic Solvent---

100 parts by weight of the emulsified slurry was set in a flask having a stirrer and a thermometer and the solvent was stirred at a stirring speed of 20 m/min at 30° C. for 12 hours and removed.

Washing and Drying---

After filtrating 100 parts by weight of the emulsified slurry under a reduced pressure, 100 parts by weight of deionized water was added to the filtration cake. The resultant was mixed with a TK HOMOMIXER with a rotation of 12,000 rpm for 10 minutes and then filtrated. 300 parts by weight of deinonization water was added to the obtained filtration cake. The resultant was mixed with a TK HOMOMIXER with a rotation of 12,000 rpm for 10 minutes and then filtrated. 300 parts by weight of deinonization water was added and filtrated. Again, the resultant was mixed with a TK HOMOMIXER with a rotation of 12,000 rpm for 10 minutes and then filtrated. Furthermore, 20 parts by weight of 10 weight % of sodium hydrate solution was added to the obtained filtration cake. The resultant was mixed with a TK HOMOMIXER with a rotation of 12,000 rpm for 30 minutes and then filtrated with a reduced pressure. 300 parts of deinonization water was added to the obtained filtration cake. The resultant was mixed with a TK HOMOMIXER with a rotation of 12,000 rpm for 10 minutes and then filtrated.

300 parts by weight of deinonization water was added to the obtained filtration cake. The resultant was mixed with a TK HOMOMIXER with a rotation of 12,000 rpm for 10 minutes and then filtrated. Again, 300 parts by weight of deinonization water was added, mixed with a TK HOMOMIXER and filtrated. Further, 20 parts by weight of 10 weight % of hydrochloric acid was added to the filtration cake. The resultant was mixed with a TK HOMOMIXER with a rotation of 12,000 rpm for 10 minutes and then filtrated. 300 parts of deinonization water was added to the obtained filtration cake. The resultant was mixed with a TK HOMOMIXER with a rotation of 12,000 rpm for 10 minutes and then filtrated. Again, 300 parts of deinonization water was added, mixed with a TK HOMOMIXER, and filtrated again.

The final filtration cake was thus obtained. The obtained final filtration cake was dried at 45° C. for 48 hours by an air circulating dryer and sieved having a mesh of 75 μm to obtain mother toner particles A. The volume average diameter of the mother toner particles A was 5.3 μm.

1.0 part by weight of hydrophobic silica (H2000, manufactured by Clariant Japan, KK) and 0.6 part by weight of titanic oxide (MT-150AI, manufactured by, Teika KK) were added to and mixed with the mother toner particles A and thus toner particles A were obtained.

---Production of Toner Particles B---

The crystalline polyester resin dispersed liquid was used to produce toner particles B instead of the plasticizer dispersed liquid used to obtain toner particles A.

---Synthesis of Crystalline Polyester Resin A---

4000 [g] of composition composed of fumaric acid (88.6 molar ratio), succinic acid (4.9 molar ratio), trimellitic anhydride (6.5 molar ratio) and 1,4-butanediol (100 molar ratio) and 4 [g] of hydroquinone were contained in a 5-liter four-necked flask equipped with a thermometer, a stirrer, a condenser and a nitrogen gas feed pipe. Then the flask containing the mixture was set into a mantle heater with nitrogen gas introduced from the nitrogen gas feed pipe for keeping atmosphere in the flask to be inert atmosphere and heated.

The mixture was heated at 160° C. for 5 hours to react the components. Then the temperature of the reaction product was raised to 200° C. and the reaction was further performed for 1 hour. Furthermore, the reaction was performed for 1 hour under a pressure of 8.3 Kpa. Thus, a crystalline polyester resin was prepared.

It was confirmed that the crystalline polyester resin has a melting point of 118° C., a number average molecular weight of 1,530 and a weight average molecular weight of 6,400.

---Preparation of Dispersion of Crystalline Polyester Resin Dispersed Liquid---

200 parts by weight of crystalline polyester resin A, 400 parts by weight of polyester resin and 800 parts by weight of ethyl acetate were mixed and stir by a bead mill (ULTRAVISCOMILL, manufactured by Aimex Co., Ltd.) under the following conditions:

Liquid feeding speed: 1 kg/hr
Disc rotation speed: 6 m/sec
Diameter of zirconia beads: 0.5 mm
Filling factor: 80% by volume
Time of dispersion treatment: 5 minutes.

Mother toner particles B were obtained by executing the same procedure as that of toner particles A, except thus obtained crystalline polyester resin dispersed liquid was used instead of the plasticizer dispersed liquid used.

The volume average diameter of the mother toner particles B was 5.3 μm.

1.0 part by weight of hydrophobic silica (H2000, manufactured by Clariant Japan, KK) and 0.6 part by weight of titanic oxide (MT-150AI, manufactured by, Teika KK) were added to and mixed with the mother toner particles B and thus toner particles B were obtained.

---Production of Toner Particles C---

Toner was prepared by a suspension polymerization method as follows:

---Preparation of Solution and/or Dispersion Liquid of Toner Component (Monomer Composition)---

The following materials were stirred and mixed at room temperature using a stirrer and uniformly dispersed by a media type dispersing device to obtain a monomer composition.

polymeric monomer formed of 80.5 parts by weight of styrene and 19.5 parts by weight of n-butylacrylate: 100 parts by weight carbon black (Printex 35, manufactured by Degussa AG, having a dibutyl phthalate (DBP) oil absorption of 42 ml/100 mg and a PH of 9.5:6 parts by weight charge control agent (Spiron black TRH, manufactured by Hodogaya Chemical Co., Ltd): 1 parts by weight divinyl benzene 0.4 parts by weight t-dodecyl mercaptan 1.0 parts by weight carnauba wax 10 parts by weight macromonomer of polymethacrylate 0.5 parts by weight plasticizer dispersed liquid prepared to produce toner particles A: 50 parts by weight ---Preparation of Aqueous Medium Phase---

Magnesium hydrate colloid (metal hydrate colloid hardly soluble in water) dispersed liquid was prepared by:

gradually dropping a first aqueous solution in which 5.8 parts by weight of sodium hydrate (alkali metal hydrate) was dissolved in 50 parts by weight of deionized water into a second aqueous solution in which 9.5 parts by weight of magnesium chloride (water-soluble multivalent metal salt) dissolved in 250 parts by weight of deionized water at room temperature while stirring.

---Granulation---

The monomer composition mentioned above was set in the obtained magnesium hydrate colloid dispersion liquid at room temperature and dispersed by stirring until the liquid droplets were stable.

Thereafter, 5 parts by weight of t-butylperoxy-2-ethylhexanoate were added thereto as an oil-soluble polymerization initiator. Further, the resultant was subject to stirring with high shearing force using a TK HOMOMIXER with a rotation of 15,000 rpm for 10 minutes to obtain fine liquid droplets formed of monomer composition.

---Polymerization---

Aqueous dispersion medium (suspension liquid) of the granulated monomer composition was set in a reaction container having a stirring blade and heated to 90° C. to start polymerization reaction. After performing polymerization reaction for 10 hours, the compound was cooled with water to complete the polymerization reaction. Next, the resultant was subject to filtration, washing and drying in the same manner as the preparation of toner particle A. Thus, toner mother particles C were prepared.

The volume average diameter of the mother toner particles C was 5.6 μm.

1.0 part by weight of hydrophobic silica (H2000, manufactured by Clariant Japan, KK) and 0.6 part by weight of titanic oxide (MT-150AI, manufactured by, Teika KK) were added to and mixed with the mother toner particles C and thus toner particles C were obtained.

---Production of Toner Particles D---

The following components were mixed with a HENSCHEL MIXER.

crystalline polyester resin A: 15 parts by weight
noncrystalline polyester resin: 35 parts by weight
(manufactured by Kao KK., Tg 63.6° C., Tm 106.1° C.)
noncrystalline polyester resin: 40 parts by weight
(manufactured by Kao KK., Tg 59.8° C., Tm 149.2° C.)
free fatty acid-removed carnauba wax: 5 parts by weight
(glass transition temperature: 83° C.)
carbon black: 10 parts by weight
(#44 from Mitsubishi Chemical Corp.)

The mixture was kneaded with a two-axis extruder and then cooled. In this regard, the temperature of the two-axis extruder was set to the minimum of the temperature range in which the mixture is melted. As a result, the temperature of the kneaded mixture was 120° C. at the exit of the extruder.

Then the kneaded mixture was pulverized and classified.

Thus, toner mother particles D having a weight average particle diameter of about 6.5 μm was prepared. The toner particles having particle diameter not greater than 5 μm in an amount of 80% by quantity (i.e., by number).

1.0 part by weight of hydrophobic silica (H2000, manufactured by Clariant Japan, KK) and 0.6 part by weight of titanic oxide (MT-150AI, manufactured by, Teika KK) were added to and mixed with the mother toner particles D and thus toner particles D were obtained.

---Production of Toner Particles E---

Toner particles E were obtained by executing the same procedure as that of toner particles A, except 200 parts of polyethylene glycol was not contained in the plasticizer dispersed liquid. (Therefore, the plasticizer dispersed liquid was exchanged by a resin liquid because the plasticizer was not contained any more.)

---Production of Toner Particles F---

Toner particles F were obtained by executing the same procedure as that of toner particles A, except the crystalline polyester resin was not contained in the crystalline polyester resin dispersed liquid. (Therefore, the crystalline polyester resin dispersed liquid was exchanged by a resin liquid because the crystalline polyester resin was not contained any more.)

---Production of Toner Particles G---

The following components were mixed with a HENSCHEL MIXER.

noncrystalline polyester resin: 60 parts by weight
(manufactured by Kao KK., Tg 63.6° C., Tm 106.1° C.)
noncrystalline polyester resin: 40 parts by weight
(manufactured by Kao KK., Tg 59.8° C., Tm 149.2° C.)
free fatty acid-removed carnauba wax: 5 parts by weight
(glass transition temperature: 83° C.)
carbon black: 10 parts by weight
(#44 from Mitsubishi Chemical Corp.)

The mixture was kneaded with a two-axis extruder and then cooled.

Then the kneaded mixture was pulverized and classified.

Thus, toner mother particles D having a weight average particle diameter of about 6.5 μm was prepared. The toner particles having particle diameter not greater than 5 μm in an amount of 80% by quantity (i.e., by number).

1.0 part by weight of hydrophobic silica (H2000, manufactured by Clariant Japan, KK) and 0.6 part by weight of titanic oxide (MT-150AI, manufactured by, Teika KK) were added to and mixed with the mother toner particles G and thus toner particles G were obtained.

The storage elastic modulus of each of toner particles A to G was measured. Toner particles A, B, C, D showed the data satisfying Gr>Gl. On the other hand, toner particles E, F, G showed the data in which Gr is almost the same as Gl.

Carrier particles were prepared as follows.

The following materials were added to 100 parts of toluene:

Silicone resin (Organo straight silicone 100 parts by weight r-(2-aminoethyl) aminopropyl trimethoxy silane 5 parts by weight Carbon black 10 parts by weight The mixture was dispersed with a HOMOMIXER for 20 minutes to prepare a coating layer forming liquid. The coating layer forming liquid was coated with a fluid bed type coating device on the surface of 1,000 parts by weight of spherical magnetite having a particle diameter of 50 μm to obtain magnetic carrier particles.

Each two-component developer A to G was prepared by mixing following particles by a ball mill 9 parts by weight of each of toner particles A to G.

91 parts by weight of carrier particles mentioned above.

Next, following experiment was done using a tandem type color image forming apparatus Imagio Neo C350 from Ricoh Company, Ltd. which is remodeled to include elements explained in FIG. 3. A cooler is implemented in the cleaning roller 26 so that the temperature can be controlled. In this experiment, the heat pipe 28 was omitted.

In the experiment, each of two-component developer A to G is used in the image forming apparatus. The measured value of the storage elastic modulus is shown in table 1. In the table 1, tf is a temperature of the image transferring-and-fixing belt 121 measured at a position nearby the position F3, tc is a temperature of the cleaning roller 26 representing the temperature of residual toner particles on the image transferring-and-fixing belt 121 when being removed. In the table 1, the measured value of the storage elastic modulus at each temperature is shown.

Figure 8:
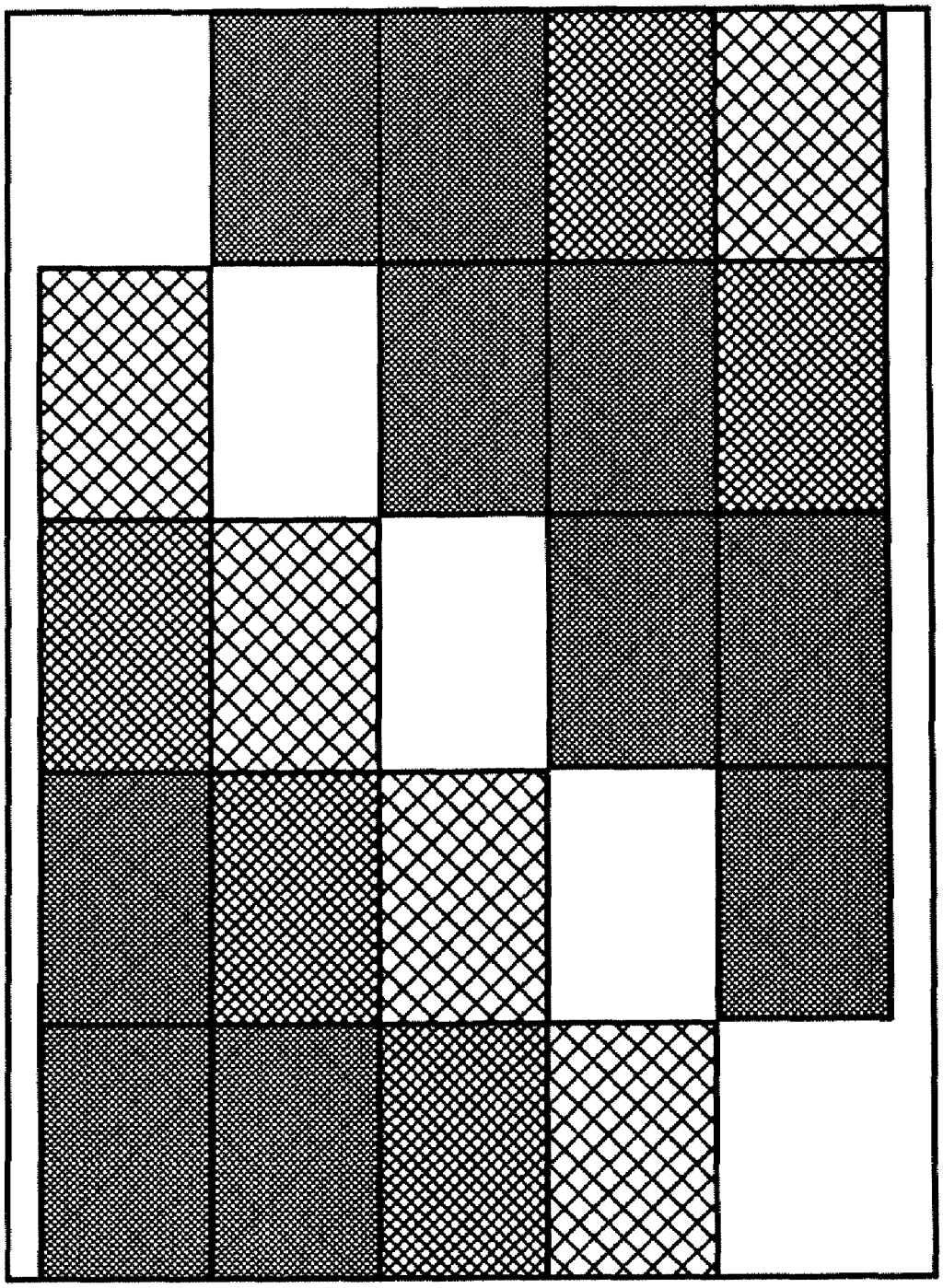
FIG. 8 shows a test image used in experiments.

Also, the temperatures of the intermediate transfer belt 4 just after passing through the cooling roller 31 are shown in the table 1. The temperatures of the intermediate transfer belt 4 were measured after 1,000 papers of an image shown in FIG. 8 were printed out on A4 size plain papers at the speed of 35 papers/min. The image shown in FIG. 8 has an image area proportion 50%. Papers used in the experiments were "type 6000<70W>Y" papers from Ricoh Company, Ltd.

A time in which a point on a paper P is in a nip between the image transferring-and-fixing belt 121 and the pressure roller 24 was designed to be 10 ms.

The image quality was estimated according to a following rule.

If an image is not distorted after 1,000 papers were printed out: Good

If an image is distorted such as fouling or streak on images after 1,000 papers were printed out: Bad As for comparative example 1, 2 and 3 in the table 1, the temperatures of the intermediate transfer belt 4 became high and printed images were distorted. As for comparative example 1 and 2 in the table 1, the experiments were stopped before 1,000 papers were printed out. Therefore, the temperatures of the intermediate transfer belt 4 of comparative example 1 and 2 is the value measured after 100 papers were printed out.

TABLE 1

| | The Developer | tf | Gr(tf)(Pa) | tc | Gl(tc)(Pa) | The Temperature of the intermediate belt (° C.) | Image Quality |
|---|---|---|---|---|---|---|---|
| Example 1 | A | 130 | $1.68 \times 10^3$ | 90 | $4.23 \times 10^3$ | 45 | ○ |
| Example 2 | B | 130 | $1.43 \times 10^3$ | 95 | $3.21 \times 10^3$ | 47 | ○ |
| Example 3 | C | 140 | $1.15 \times 10^3$ | 95 | $8.16 \times 10^3$ | 48 | ○ |
| Example 4 | D | 120 | $2.21 \times 10^3$ | 85 | $4.63 \times 10^3$ | 45 | ○ |
| Comparative Example 1 | E | 160 | $1.18 \times 10^3$ | 130 | $7.43 \times 10^3$ | 82 (after 100 papers printed out) | X |
| Comparative Example 2 | F | 160 | $1.92 \times 10^3$ | 135 | $6.28 \times 10^3$ | 84 (after 100 papers printed out) | X |
| Comparative Example 3 | G | 150 | $1.10 \times 10^3$ | 120 | $5.23 \times 10^3$ | 68 | X |
| Comparative Example 4 | E | 160 | $1.18 \times 10^3$ | 100 | $1.26 \times 10^5$ | 50 | X |
| Comparative Example 5 | F | 160 | $1.92 \times 10^3$ | 100 | $8.26 \times 10^4$ | 49 | X |
| Comparative Example 6 | G | 150 | $1.10 \times 10^3$ | 100 | $7.18 \times 10^4$ | 49 | |

As for comparative example 1, 2 and 3 in the table 1, the residual toner particles remaining on the image transferring-and-fixing belt 121 were removed well. However, when being cleaned, the temperature of the image transferring-and-fixing belt 121 was so high that the temperature of the intermediate transfer belt 4 became equal to or greater than 50° C., the "toner filming" on the surface of the photoconductor 3Y to 3BK occurred and the image quality deteriorated.

As for comparative example 4, 5 and 6 in the table 1, since the temperature of the cleaning roller 26 was low, the temperature of the intermediate transfer belt 4 became not greater than 50° C. and the "toner filming" on the surface of the photoconductor 3Y to 3BK did not occur. However, since the temperature of the cleaning roller 26 was low, the cleanability of the cleaning roller 26 declined, therefore the toner adhesion to non-image area of images on papers occurred and the image quality deteriorated.

Toner particles having above explained storage elastic modulus can be useful in various image forming apparatus other than image forming apparatuses in above embodiments.

What is claimed is:

1. Toner particles comprising a binder resin and a plasticizer, wherein the binder resin is a polyester resin and the plasticizer is a crystalline polyester resin, wherein the binder resin and crystalline polyester resin are present as separate particles in the toner particles and are soluble in one another when heated above the melting temperature of the crystalline polyester resin, wherein a following relation is satisfied within a range of temperature not smaller than Tg and smaller than TL:

$$Gr>Gl$$

wherein Gr is a storage elastic modulus of the toner particles measured when the toner particles are heated in a temperature range T, Gl is a storage elastic modulus of the toner particles measured when toner particles are cooled in the temperature range T, wherein the temperature range T is a range from a temperature TL that is 10° C. lower than a temperature Tm that is a flow starting temperature of the toner particles, to a temperature Tg that is a glass transition temperature of the toner particles.

2. A developer comprising the toner particles of claim 1.

3. An image present on a recording medium, wherein the image is formed by developing and fixing a toner image comprising the toner particles of claim 1 on the recording medium.

4. A process cartridge configured to be detachable from a main body of an image forming apparatus, comprising:

a latent image carrier;

at least one of a charger, a developing device and a cleaner; and the toner particles of claim 1.

5. An image forming process, comprising:

forming a toner image on a photoconductor;

transferring the toner image onto an intermediate transfer body;

transferring the toner image from the intermediate transfer body to a transferring-and-fixing body;

transferring the toner image from the transferring-and-fixing body to a recording medium and fixing the toner image on the recording medium by simultaneously heating the recording medium with the transferring-and-fixing body, and pressing the recording medium against the transferring-and-fixing body;

wherein the transferring and fixing is carried out at a temperature range T that is 10° C. less than the temperature at which the toner particles of the toner image begin to flow, and the glass transition temperature of the toner particles, and wherein the toner is a toner according to claim 1.

6. The process according to claim 5, further comprising:

after the transferring and fixing, cleaning residual toner particles from the transferring-and-fixing body with a cleaning body.

7. The process of claim 5, wherein during the transferring and fixing, the resin and the plasticizer dissolve in one another.

8. An image forming apparatus, comprising:

toner particles according to claim 1;

a latent image carrier configured to carry latent images;

a developing device configured to develop latent images on the latent image carrier to toner images with the toner particles;

an intermediate transfer body to which toner images on the latent image carrier are transferred;

a transferring-and-fixing body to which toner images are transferred from the intermediate transfer body;

a heater configured to heat toner images on the transferring-and-fixing body;

a pressure body configured to be pressed against the transferring-and-fixing body;

a cleaner for the transferring-and-fixing body configured to remove the toner particles from the transferring-and-fixing body;

wherein the toner images on the transferring-and-fixing body heated by the heater are transferred to and fixed to a recording medium simultaneously while the recording medium moves through between the transferring-and-fixing body and the pressure body, the toner particles are removed by the cleaner from the transferring-and-fixing body after the toner images are transferred to and fixed to the recording medium simultaneously.

9. The image forming apparatus according to claim 8, wherein following relations are satisfied:

$$tf-30^\circ\ \text{C.} > tc^\circ\ \text{C.}$$

$$Gl(tc)/Gr(tf) < 10$$

wherein tf is the temperature of the toner particles when the toner particles on the transferring-and-fixing body are transferred to the recording medium and tc is the temperature of the toner particles when the toner particles on the transferring-and-fixing body are removed by the cleaning body, Gr(tf) is the value of Gr measured at the temperature tf, and Gl(tc) is the value of Gl measured at the temperature tc.

10. The image forming apparatus according to claim 8, wherein following relations are satisfied:

$$5\times10^2\ [\text{Pa}] < Gr(tf) < 1\times10^4\ [\text{Pa}]$$

$$1\times10^3\ [\text{Pa}] < Gl(tc) < 5\times10^4\ [\text{Pa}].$$

11. The image forming apparatus according to claim 8, further comprising:

a cooler configured to cool the transferring-and-fixing body disposed at upstream of a position F2 and at downstream of a position F3 in the rotating direction of the transferring-and-fixing body, wherein the position F2 is a position at which toner images on the latent image carrier are transferred to the intermediate transfer body, and the position F3 is a position at which toner images on the intermediate transfer body are transferred to the transferring-and-fixing body.

12. The image forming apparatus according to claim 8, wherein the cleaner includes a cleaning roller.

13. The image forming apparatus according to claim 12, wherein fine convexes and concaves are present on the surface of the cleaning roller.

14. The image forming apparatus according to claim 13, wherein a widthwise length of the cleaning roller is greater than a widthwise length of the intermediate transfer body.

15. The image forming apparatus according to claim 8, wherein the toner particles are produced by suspension polymerization method in which the toner particles are obtained by at least one of emulsifying and dispersing at solution and/or dispersion liquid of a toner component in an aqueous medium followed by granulating to form the toner particles.

16. An image forming apparatus comprising:

toner particles according to claim 1;

a latent image carrier configured to carry latent images;

a developing device configured to develop latent images on the latent image carrier to toner images with the toner particles;

an intermediate transfer body to which toner images on the latent image carrier are transferred;

a heater configured to heat toner images on the intermediate transfer body;

a pressure body configured to be pressed against intermediate transfer body;

a cleaner for the intermediate transfer body configured to remove the toner particles from the intermediate transfer body;

wherein the toner images on the intermediate transfer body heated by the heater are transferred to and fixed to a recording medium simultaneously while the recording medium moves through between the intermediate transfer body and the pressure body, the toner particles are removed by the cleaner from the intermediate transfer body after the toner images are transferred to and fixed to the recording medium simultaneously.

17. The image forming apparatus according to claim 16, wherein following relations are satisfied:

$$tf-30^\circ\ \text{C.} > tc^\circ\ \text{C.}$$

$$Gl(tc)/Gr(tf) < 10$$

wherein tf is the temperature of the toner particles when the toner particles on the transferring-and-fixing body are transferred to the recording medium and tc is the temperature of the toner particles when the toner particles on the transferring-and-fixing body are removed by the cleaning body, Gr(tf) is the value of Gr measured at the temperature tf, and Gl(tc) is the value of Gl measured at the temperature tc.

18. The image forming apparatus according to claim 16, wherein following relations are satisfied:

$$5\times10^2\ [\text{Pa}] < Gr(tf) < 1\times10^4\ [\text{Pa}]$$

$$1\times10^3\ [\text{Pa}] < Gl(tc) < 5\times10^4\ [\text{Pa}].$$

19. The image forming apparatus according to claim 16, further comprising:

a cooler configured to cool the transferring-and-fixing body disposed at upstream of a position F2 and at downstream of a position F3 in the rotating direction of the transferring-and-fixing body, wherein the position F2 is a position at which toner images on the latent image carrier are transferred to the intermediate transfer body, and the position F3 is a position at which toner images on the intermediate transfer body are transferred to the transferring-and-fixing body.

20. The image forming apparatus according to claim 16, wherein the cleaner includes a cleaning roller.

21. The image forming apparatus according to claim 20, wherein fine convexes and concaves are present on the surface of the cleaning roller.

22. The image forming apparatus according to claim 21, wherein a widthwise length of the cleaning roller is greater than a widthwise length of the intermediate transfer body.

23. The image forming apparatus according to claim 16, wherein the toner particles are produced by suspension polymerization method in which the toner particles are obtained by at least one of emulsifying and dispersing at solution and/or dispersion liquid of a toner component in an aqueous medium followed by granulating to form the toner particles.

* * * * *